US006638128B1

(12) United States Patent
Suzuki

(10) Patent No.: US 6,638,128 B1
(45) **Date of Patent: *Oct. 28, 2003**

(54) APPARATUS AND METHOD FOR MANUFACTURING ELECTRON SOURCE, AND METHOD OF MANUFACTURING IMAGE-FORMING APPARATUS

(75) Inventor: Noritake Suzuki, Atsugi (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/511,690

(22) Filed: Feb. 23, 2000

(30) Foreign Application Priority Data

Feb. 23, 1999 (JP) ..... 11-044718
Feb. 23, 2000 (JP) ..... 2000-045678

(51) Int. Cl.[7] ..... H01J 9/02
(52) U.S. Cl. ..... 445/6; 445/24; 445/62
(58) Field of Search ..... 445/6, 62

(56) References Cited

U.S. PATENT DOCUMENTS

| | | | | |
|---|---|---|---|---|
| 5,066,883 A | | 11/1991 | Yoshioka et al. | 313/309 |
| 5,500,743 A | | 3/1996 | Sakaegi et al. | 358/403 |
| 5,591,061 A | * | 1/1997 | Ikeda et al. | 445/6 |
| 5,593,335 A | | 1/1997 | Suzuki et al. | 445/50 |
| 5,644,653 A | | 7/1997 | Sunakawa et al. | 382/187 |
| 5,734,361 A | | 3/1998 | Suzuki et al. | 345/74 |
| 6,009,232 A | | 12/1999 | Sakaegi et al. | 386/70 |
| 6,053,791 A | * | 4/2000 | Fujii et al. | 445/6 |

FOREIGN PATENT DOCUMENTS

| | | |
|---|---|---|
| JP | 64-31332 | 2/1989 |
| JP | 2-257551 | 10/1990 |
| JP | 7-176265 | 7/1995 |

OTHER PUBLICATIONS

W.P. Dyke, et al., "Field Emission", Advances in Electronics and Electron Physics, vol. VIII, pp. 89–185 (1956).

C.A. Spindt, et al., "Physical Properties of Thin–Film Field Emission Cathodes with Molybdenum Cones", Journal of Applied Physics, vol. 47, No. 12, pp. 5248–5263 (Dec. 1976).

C.A. Mead, "Operation of Tunnel–Emission Devices", Journal of Applied Physics, vol. 32, No. 4, pp. 646–652 (Apr. 1961).

M.I. Elinson, et al., "The Emission of Hot Electrons and the Field Emission of Electrons from Tin Oxide", Radio Engineering and Electronic Physics, No. 7, pp. 1290–1296 (Jul. 1965).

M. Hartwell, et al., "Strong Electron Emission from Patterned Tin–Indium Oxide Thin Films", International Electron Devices Meeting, pp. 519–521 (1975).

G. Dittmer, "Electrical Conduction and Electron Emission of Discontinuous Thin Films", Thin Solid Films, No. 9, pp. 317–328 (1972).

H. Araki, et al., "Electroforming and Electron Emission of Carbon Thin Films", Journal of the Vacuum Society of Japan, vol. 26, No. 1, pp. 22–29 (Jan. 1983).

* cited by examiner

*Primary Examiner*—Kenneth J. Ramsey
(74) *Attorney, Agent, or Firm*—Fitzpatrick, Cella, Harper & Scinto

(57) ABSTRACT

An electron is source formed by a plurality of electron-emitting devices provided on a substrate and connected by a wiring. Use of an electron ray manufacturing apparatus having electrical connecting means connected to the wiring at three or more points can uniformize characteristics of a plurality of the electron-emitting devices.

19 Claims, 25 Drawing Sheets

APPARATUS AND METHOD FOR MANUFACTURING ELECTRON SOURCE, AND METHOD OF MANUFACTURING IMAGE-FORMING APPARATUS

BACKGROUND OF THE INVENTION

1. Field of the Invention

The present invention relates to a technique for manufacturing an electron source and an image-forming apparatus to which the electron source is applied, and more particularly to an apparatus and a method for manufacturing an electron source having a plurality of electron-emitting devices.

2. Related Background Art

Conventionally, two types of electron-emitting device, i.e., a hot cathode device and a cold cathode device are known. As one of these devices, i.e., the cold cathode device, for example, a field emission device (which will be referred to as an FE hereinafter), a metal/insulation layer/metal emission device (which will be referred to as an MIM hereinafter) or a surface conduction emission device are known.

As an example of the FE, there is known a device disclosed in W. P. Dyke & W. W. Dolan, "Field emission", Advance in Electron Physics, 8, 89 (1956) or that disclosed in C. A. Spindt, "Physical properties of thin-film field emission cathodes with molybdenium cones", J. Appl. Phys., 47, 5248 (1976).

Further, as an example of the MIM, C. A. Mead, "Operation of tunnel-emission Devices", J. Appl. Phys., 32, 646 (1961) is known.

Furthermore, as the surface conduction emission device, an example of M. I. Elinson Radio Eng. Electron Phys., 10, 1290, (1965) or later-described another example is known.

The surface conduction emission device utilizes such a phenomenon as that flowing an electric current through a small-sized thin film formed on a substrate in parallel to a film surface causes electron emission to be produced. As the surface conduction emission device, there are reported a device using an Au thin film [G. Dittmer: "Thin Solid Films", 9,317 (1972)], a device using an $In_2O_3/SnO_2$ thin film [M. Hartwell and C. G. Fonstad:"IEEE Trans. ED Conf.", 519 (1975)], a device using a carbon thin film [Hisashi Araki and et al.: Vacuum, Vol. 26, No. 1, 22 (1983)] and others, as well as the above-described device using an $SnO_2$ thin film by Elinson and the like.

As a typical example of the device structure of these surface conduction emission devices, a plan view of the above-mentioned device by M. Hartwell and et al. is shown in FIG. 22. In the drawing, reference numeral 3001 denotes a substrate, and 3004 designates an electroconductive thin film consisting of a metal oxide formed by spattering. The electroconductive thin film 3004 is formed into a planar H-like shape as shown in the drawing. When a later-described energization operation called an energization forming operation is performed with respect to the electroconductive thin film 3004, an electron-emitting region 3005 is formed. In the drawing, a distance L is set to 0.5 to 1 [mm] and W is set to 0.1 [mm]. Although the electron-emitting region 3005 having a rectangular shape is shown in the central part of the electroconductive thin film 3004 for the sake of convenience, this is a typical arrangement and does not faithfully represent a position or a shape of the actual electron-emitting region.

In the above-described surface conduction emission device including the devices by M. Hartwell and others, it is general to form the electron-emitting region 3005 by carrying out the energization operation called the energization forming to the electroconductive thin film 3004 before performing the electron emission. That is, the energization forming means that a constant direct-current voltage or a direct-current voltage which rises at a very slow rate of, e.g., approximately 1V/min is applied to both ends of the electroconductive thin film 3004 for energization and the electroconductive thin film 3004 is then locally fractured, deformed or transformed to form the electron-emitting region 3005 having an electrically high resistance. It is to be noted that a fissure is generated to a part of the electroconductive thin film 3004 which has been locally fractured, deformed or transformed. When an appropriate voltage is applied to the electroconductive thin film 3004 after the energization forming, the electron emission is performed in the vicinity of the fissure.

Since the surface conduction emission device has a simple structure and can be easily manufactured, a plurality of devices can be advantageously formed over a large area. Therefore, as disclosed in, e.g., Japanese Patent Application Laid-open No. 64-31332 by the present applicant, a method for arranging and driving a plurality of devices has been studied.

As an application of the surface conduction emission device, for example, an image-forming apparatus such as an image-displaying apparatus or an image-recording apparatus or a charged beam source and the like have been studied.

In particular, as an application to the image-displaying apparatus, an image-displaying apparatus using a combination of the surface conduction emission device and a phosphor which emits light by irradiation of an electron beam has been studied as disclosed in, e.g., U.S. Pat. No. 5,066,883 or Japanese Patent Application Laid-open No. 2-257551 by the present applicant. An image-displaying apparatus using a combination of the surface conduction emission device and the phosphor is expected for its characteristic superior to a prior art image-displaying apparatus adopting any other mode. For example, it can be said that such an apparatus is superior to a recently spread liquid crystal display unit in that this apparatus is of a spontaneous light emission type which requires no back light and has a wider view angle.

The present applicants have tried production of the surface conduction emission device having various materials and structures by a variety of methods in addition to the devices described in the above prior arts. Further, they have studied a multi-electron source in which plural surface conduction emission devices are arranged and an image-displaying apparatus to which the multi-electron source is applied.

The present applicants have tried manufacturing of the multi-electron beam source obtained by an electrical wiring method such as shown in FIG. 23. That is the multi-electron beams source in which a plurality of surface conduction emission devices are arranged in the two-dimensional manner and these devices are wired in the matrix form.

In the drawing, reference numeral 4001 denotes a typically shown surface conduction emission device; 4002, a row-directional wiring; and 4003, a column-directional wiring. Although the row-directional wiring 4002 and the column-directional wiring 4003 actually have the finite electric resistance, the wiring resistance 4004 and 4005 is shown in the drawing. The above-described wiring method is referred to as a simple matrix wiring.

Incidentally, although a 6×6 matrix is shown for the sake of convenience, the scale of the matrix is not restricted thereto, and the devices whose number can suffice the desired image display are arranged and wired in case of, for example, the multi-electron beam source for the image-displaying apparatus.

In the multi-electron beam source in which the surface conduction emission devices are simple-matrix-wired, an appropriate electric signal is applied to the row-directional wiring 4002 and the column-directional wiring 4003 in order to output a desired electron beam. For example, in order to drive the surface conduction emission device in an arbitrary row in the matrix, a selected voltage Vs is applied to the row-directional wiring 4002 for a selected row and a non-selected voltage Vns is applied to the row-directional wiring 4002 for a non-selected row at the same time. In synchronism with this, a drive voltage Ve for outputting an electron beam is applied to the column-directional wiring 4003. According to this method, if a drop in voltage due to the wiring resistance 4004 and 4005 is ignored, a voltage of Ve−Vs is applied to the surface conduction emission device in the selected row and a voltage Ve−Vns is applied to the surface conduction emission device in the non-selected row. If Ve, Vs and Vns are set to voltages having appropriate values, an electron beam having a desired intensity must be outputted from only the surface conduction emission device in the selected row. Further, if different voltages Ve are applied to each of the column-directional wiring, an electron beam having a different intensity must be outputted from each device in the selected row. Since the response speed of the surface conduction emission device high, changing a duration of time for applying the drive voltage Ve must change a duration of time for outputting the electron beam.

Therefore, various applications of the multi-electron beam source in which the surface conduction electron devices are wired in the simple matrix form are considered, and the multi-electron beam source is expected to be applied as the electron source for the image-displaying apparatus when a voltage signal responsive to, e.g., image information is appropriately applied.

On the other hand, as a result of the eager study for improving the characteristic of the surface conduction electron-emitting device, the present inventors have discovered that execution of the energization activation operation in the manufacturing process is effective.

As described above, when forming the electron-emitting region of the surface conduction electron-emitting device, there is performed an operation (energization forming operation) for flowing an electric current through the electroconductive thin film to locally fracture, deform or transform the thin film, thereby forming a fissure. The electron-emitting characteristic can be greatly improved by further performing the energization activation operation.

That is, the energization activation operation means an operation by which energization is applied to the electron-emitting region formed by the energization forming operation under an appropriate condition and carbon or carbon compound is deposited in the vicinity of this region. For example, in the vacuum atmosphere having a full pressure of $10^{-4}$ to $10^{-5}$ [Torr] in which an organic matter having an appropriate partial pressure exists, periodic application of a voltage pulse causes any of monocrystal graphite, polycrystal graphite and amorphous carbon or a mixture thereof to be deposited in the vicinity of the electron-emitting region so as to have a film thickness of not more than 500 [Å]. However, this condition is just an example, and it is needless to say that such a condition should be appropriately modified in accordance with a material or a shape of the surface conduction emission device.

When such an operation is conducted, the emission current can be typically centuplicated with the same applied voltage as compared with that obtained immediately after the energization forming. It is to be noted that reduction in the partial pressure of the organic matter in the vacuum atmosphere is desirable after completion of the energization activation operation.

Therefore, even in production of the above-described multi-electron source in which a plurality of the surface conduction electron-emitting devices are wired in the form of a simple matrix, application of the energization activation operation to each device is desirable.

When applying the surface conduction electron-emitting device, the manufacturing process of which includes the high resistance operation and the energization activation operation, to the image-forming apparatus in this manner, there occur the following problems. The problems of the energization activation operation in the manufacturing process will be described hereunder.

In various kinds of image-forming panels to which the surface conduction electron-emitting device is applied, an image with high grade and high definition is understandably desired. To realize this, for example, a plurality of surface conduction electron-emitting devices wires in the form of a simple matrix are used. Thus the arrangement of vast many devices in which numbers of rows and columns reach several hundreds to several thousands is required and the uniform device characteristic of each surface conduction electron-emitting device are desired. Many surface conduction electron-emitting devices must be uniformly and rapidly manufactured in order to actually produce various kinds of image-forming panels with high grade and high definition.

For example, as a method for manufacturing plural surface conduction electron-emitting devices by the energization forming, the present applicants have already made an application for the energization method (Japanese Patent Application Laid-open No. 7-176265).

In addition, as a method for manufacturing a plurality of the surface conduction electron-emitting devices by the energization activation operation, the present applicants conducted the method by which the surface conduction electron-emitting devices matrix-wired in procession are divided into multiple groups and a voltage for the energization activation is sequentially applied in group units. That is, for example, the voltage for activation is sequentially applied to the surface conduction electron-emitting devices arranged in M rows and N columns such as shown in FIG. 24 row by row, one row being used as a unit. In the drawing, reference characters $EY_1$ to $EY_n$ and $EX_1$ to $EX_M$ represent a wiring.

FIG. 25 illustrates a case where a voltage for energization activation is applied to the surface conduction electron-emitting device in, for example, the second row, and a voltage source for energization activation is connected to the wiring in the second row while a ground level, i.e., 0(V) is connected to any other electrode as shown in the drawing. According to this method, the voltage for energization activation is applied only to the surface conduction electron-emitting device in the second row in principle, and no voltage is applied to other surface conduction electron-emitting devices or no electric current is caused to flow thereto. When the energization activation was actually carried out by using this method, the uniformity of the electron-emitting characteristic of the surface conduction electron-emitting devices was improved.

Such a method for applying the voltage for activation can be similarly applied to a multi-surface conduction electron-emitting device substrate having the ladder-like wiring.

SUMMARY OF THE INVENTION

An object of the present invention is, in the above-described energization operation method in production of an electron source, to provide novel means and method by which an electron source including a plurality of electron-emitting devices having a uniform characteristic can be manufactured.

Another object of the present invention is, in an energization activation method in the above-mentioned energization operation method in particular, to provide novel means and method by which an electron source including a plurality of electron-emitting devices having a uniform characteristic can be manufactured.

The present invention provides an apparatus for manufacturing an electron source which is disposed on a substrate and has a plurality of electron-emitting devices connected by a wiring, the apparatus for manufacturing an electron source comprising electrical connecting means connected to the wiring at three or more points.

Further, the present invention provides a method for manufacturing an electron source which is disposed on a substrate and has a plurality of electron-emitting devices connected by a wiring, the method for manufacturing an electron source comprising an energization step carried out by energization from the electrical connecting means connected to the wiring at three or more points.

Furthermore, the present invention provides a method for manufacturing an electron source comprising the steps of: forming a plurality of electroconductive films connected by wiring on a substrate; and energizing a plurality of the electroconductive films by the electrical connecting means connected to the wiring at three or more points, a temperature of the substrate being controlled in the energizing step.

Moreover, the present invention provides a method for manufacturing an electron source comprising the steps of: forming a plurality of electroconductive films matrix-wired by a plurality of row-direction wiring and a plurality of column-direction wiring on a substrate; and energizing a plurality of the electroconductive films by the electrical connecting means connected to the row-directional wiring at three or more points, a temperature of the substrate being controlled in the energizing step.

In addition, the present invention provides a method for manufacturing an electron source comprising the steps of: forming a plurality of electroconductive films matrix-wired by a plurality of row-directional wiring and a plurality of column-directional wiring on a substrate; and energizing a plurality of the electroconductive films by the electrical connecting means connected to two or more row-directional wiring of a plurality of the row-directional wiring and respectively connected to the two or more row-directional wiring at three or more points, a temperature of the substrate being controlled in the energizing step.

DETAILED DESCRIPTION OF THE PREFERRED EMBODIMENTS

Figure 1:
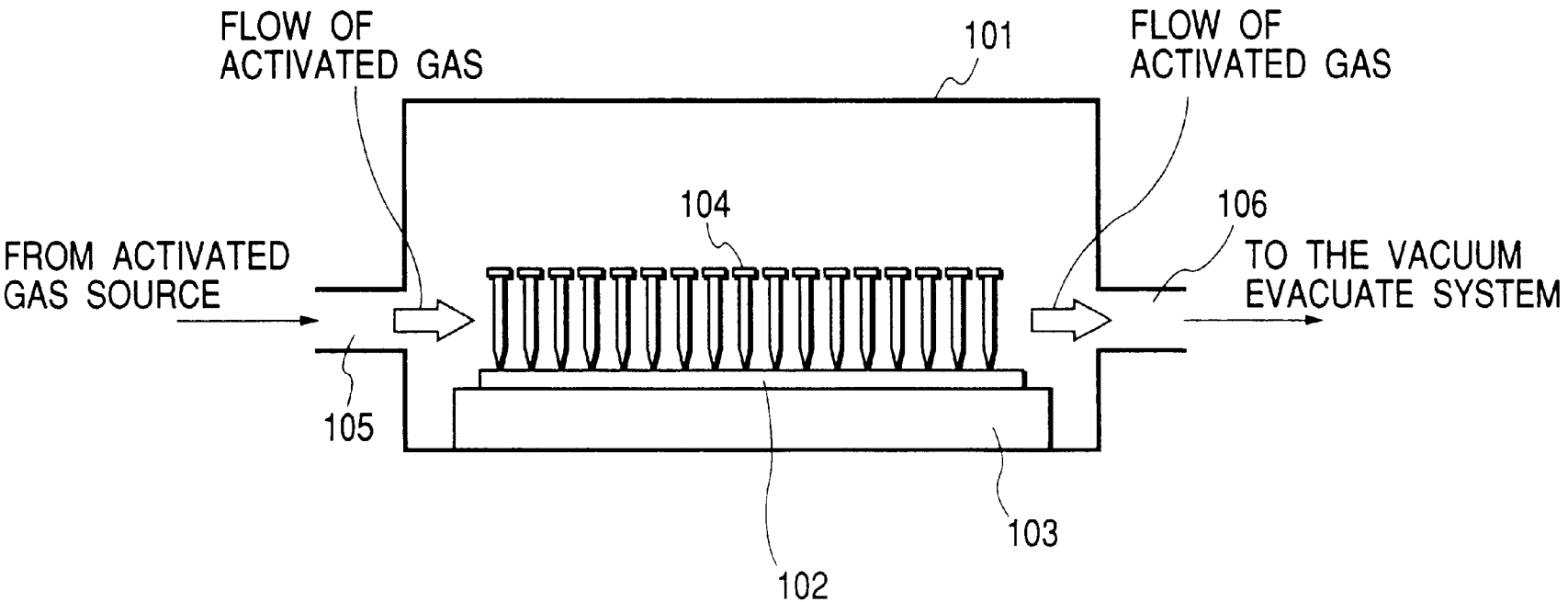
FIG. 1 is a cross-sectional view of a probe section according to a first embodiment of the present invention.

The present invention is characterized by including an energization step carried out by energization from electrical connecting means connected to a wiring, when manufacturing an electron source having a plurality of surface conduction emission devices which are disposed on a substrate and connected by the wiring.

Further, another characteristic of the present invention lies in that the electrical connecting means is connected to the wiring at three or more points.

In a preferred embodiment according to the present invention, the electrical connecting means has three or more contact terminals brought into contact with the wiring at three or more points.

Further, the respective contact terminals are arranged in such a manner that the gaps between the adjacent contact terminals become equal in an area in which the surface conduction emission device is arranged on the substrate.

Furthermore, the contact terminals are disposed so as to be parallel with a flow of an activated material gas in order to perform an energization activation step as the energization step in particular.

In the electron source to which the energization step according to the present invention is applied, a plurality of surface conduction electron-emitting devices may be laid out in the form of a matrix so that one terminal of each of the surface conduction electron-emitting devices laid out in the same row is connected to the row-directional wiring and the other terminal of each of the surface conduction electron-emitting devices laid out in the same column is connected to the column-directional wiring, or a plurality of the surface conduction electron-emitting devices may be linearly laid out so that the terminals of the surface conduction electron-emitting devices on the same side are commonly connected and the terminals on the other side are connected to a common wiring.

In accordance with another aspect of the present invention, there is provided a method for manufacturing an electron source, comprising the steps of: forming a plurality of electroconductive films connected by a wiring on a substrate; and energizing a plurality of the electroconductive films by electrical connecting means connected to the wiring at three or more points, a temperature of the substrate being controlled in the energizing step.

Here, the energizing step is preferably carried out in an atmosphere in which an organic compound exists.

In accordance with still another aspect of the present invention, there is provided a method for manufacturing an electron source, comprising the steps of: forming a plurality of electroconductive films wired in the form of a matrix by a plurality of row-directional wiring and a plurality of column-directional wiring on a substrate; and energizing a plurality of the electroconductive films by electrical connecting means connected to the row-directional wiring at three or more points, a temperature of the substrate being controlled in the energizing step.

Here, it is preferable that the row-directional wiring is a wiring disposed on the column-directional wiring or the energizing step is carried out in an atmosphere in which an organic compound exists.

In accordance with yet another aspect of the present invention, there is provided a method for manufacturing an electron source, comprising the steps of: forming a plurality of electroconductive films wired in the form of a matrix by a plurality of row-directional wiring and a plurality of column-directional wiring on a substrate; and energizing a plurality of the electroconductive films by electrical connecting means which is connected to two or more row-directional wiring of a plurality of the row-directional wiring and respectively connected to the two or more row-directional wiring at three or more points, a temperature of the substrate being controlled in the energizing step.

Here, it is preferable that the row-directional wiring is a wiring disposed on the column-directional wiring or the energizing step is carried out in an atmosphere in which an organic compound exists.

The above-mentioned some structures are also effective in the preliminary drive operation, and application of these structures can eliminate a voltage distribution generated on the wiring and realize the electron source having the uniform device characteristic without a distribution of the activated gas.

A preliminary drive operation will be described hereunder.

As described thus far, when forming the electron-emitting region of the surface conduction emission device, carbon or carbon compound is deposited in the vicinity of the electron-emitting region by the energization activation operation after the energization forming operation. After the energization activation operation, it is preferable to perform a stabilization operation. This operation is a step for evacuating an organic substance in a vacuum chamber. It is desirable to employ a vacuum evacuation apparatus using no oil in such a manner that an organic substance such as oil generated from the apparatus adversely affect the device characteristic. Specifically, there are a magnetic levitated turbo molecular pump, a cryo pump, a sorption pump, an ion pump and any other vacuum evacuation apparatus. A partial pressure of the organic component in the vacuum chamber is preferably not more than $1\times10^{-6}$ Pa which does not cause the carbon and the carbon compound to be newly deposited, or more preferably not more than $1\times10^{-8}$ Pa. Further, when evacuating the inside of the vacuum chamber, it is preferable to heat the entire vacuum chamber in order to facilitate evacuation of molecules of the organic substance absorbed by the inner wall of the vacuum chamber or the electron-emitting device. The energization operation carried out prior to the regular drive in the atmosphere in which the partial pressure of the organic matter in the vacuum atmosphere obtained by the stabilization operation is reduced is a preliminary drive operation.

In the surface conduction emission device, the intensity of the electric field in the vicinity of the electron-emitting region during the driving is extremely high. Driving in the long period of time with the same drive voltage causes such a problem as that an amount of emission electrons is gradually reduced. It can be considered that a variation with time in the vicinity of the electron-emitting region due to the high intensity of the electric field occurs as a reduction in the amount of emission electrons.

Description will now be given on this point. According to Fowler, Nordheim and others, the relationship between an electric current I discharged from the FE electron-emitting device and a voltage V applied between the cathode and the gate can be represented as follows:

$$I=A\cdot(\beta\cdot V)^2\cdot\exp(-B/(\beta\cdot V)) \quad \text{(Expression 3)}$$

In the expression, A and B represent constants depending on a material in the vicinity of the electron-emitting region and an emission area, and β denotes a parameter depending on a shape in the vicinity of the electron-emitting region. A value obtained by multiplying the voltage V by β is the electric field intensity. Here, description is given as to the FE electron-emitting device as an example because it has been discovered that the above expression can be similarly represented with respect the surface conduction electron-emitting device by only substituting the electron current or the emission current I for the voltage V applied between a pair of electrodes.

Figure 17:
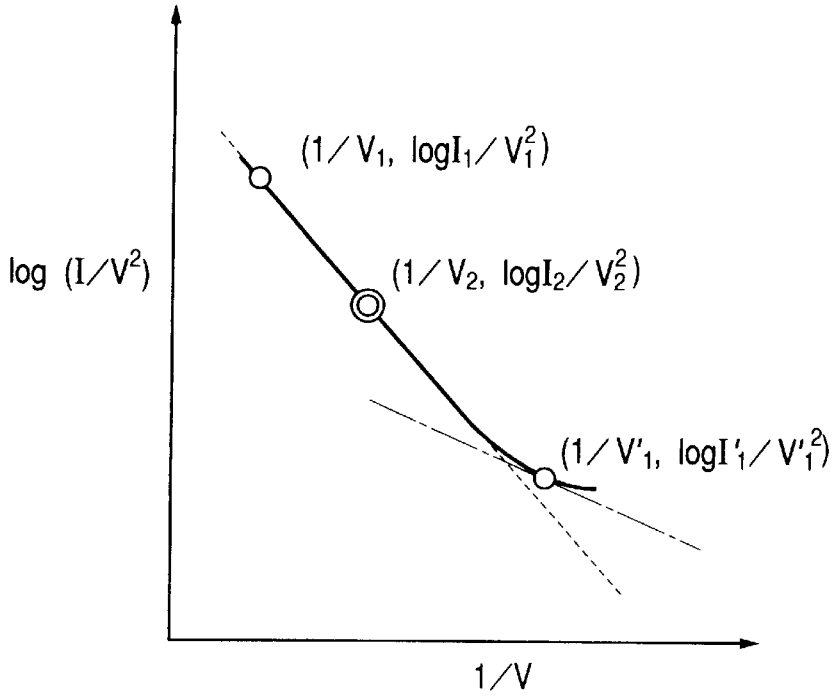
FIG. 17 is a graph showing an example of an electrical characteristic of an electron-emitting device to which the present invention can be applied.

When approximating the electrical characteristic plotted on the graph of FIG. 17 by a straight line (broken line in FIG. 17), it can be found that the following value obtained by adding a negative sign to the value calculated by dividing the applied voltage V by an inclination S of an approximate line is proportionate to the intensity of the electric field formed between the cathode 23 and the gate 24:

$$-V/S \quad \text{(Expression 4)}$$

Expressing the above relationship in the further generalized manner, the relationship between the emission current I and the voltage V can be represented by the following function:

$$I=f(V) \quad \text{(Expression 5)}$$

Further, assuming that f'(V) is a differential coefficient of f(V) in the voltage V, the electric field intensity in the voltage V can be represented as follows based on (Expression 3):

$$F=\beta\cdot V=B\cdot f(V)/\{V\cdot f'(V)-2f(V)\} \quad \text{(Expression 6)}$$

Further, it can be found that the electric field intensity is proportionate to the following expression:

$$f(V)/\{V\cdot f'(V)-2f(V)\} \quad \text{(Expression 7)}$$

A typical value of the electric field intensity in the FE electron-emitting device is a very high value of approximately $10^7$ V/em order. This point can be also applied between a pair of electrodes of the surface conduction electron-emitting device.

When the long-time driving is continued with such a large electric field intensity by the ordinary method, a change in the constituent parts occurs at odd intervals in the strong electric field, which leads to the unstable discharge current value.

Further, if the above change is irreversibly generated, a reduction in the emission current is involved, and this occurs as a decrease in the brightness in the image-displaying apparatus.

The instability of the current during driving can be reduced by performing the preliminary drive which is a drive method carried out prior to the regular drive.

The preliminary drive according to the present invention is effected by, for example, the following procedure.

Figure 18:
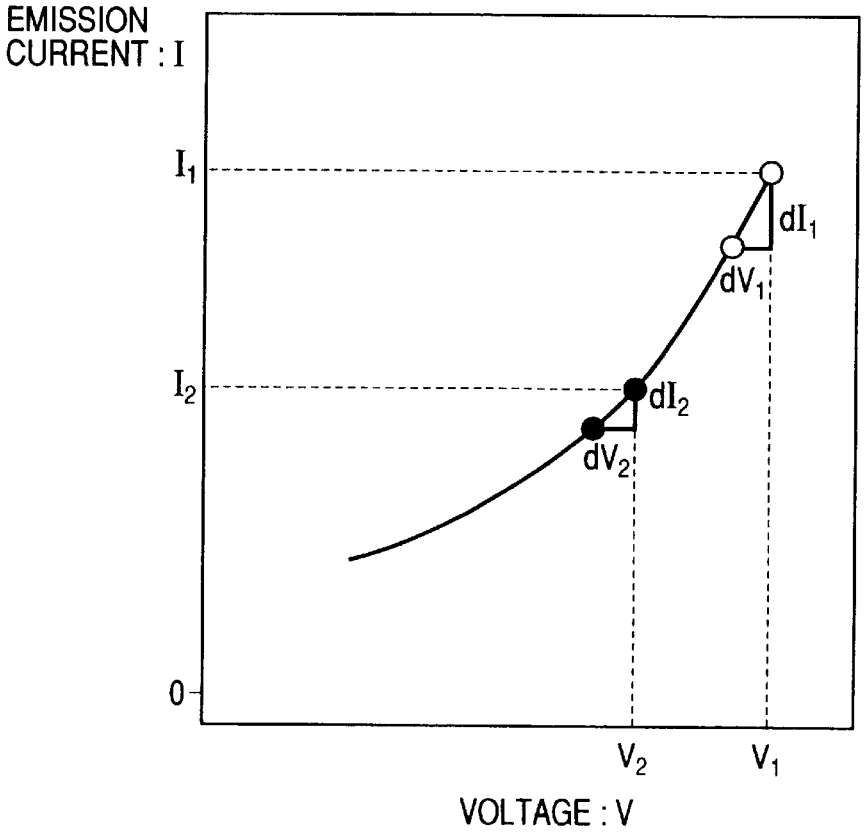
FIG. 18 is an electrical characteristic diagram in which a graduation of FIG. 17 is changed.

Firstly, in the electron-emitting device to which the preliminary drive is applied, the applied voltage and the emission current under at least two pairs of different drive voltages, and a differential coefficient of the emission current under each applied voltage are obtained. For example, as shown in FIG. 18, the emission current value I1 associated with the applied voltage V1 and the differential coefficient I'1 of the emission current are obtained from an amount of change dI1 in the emission current obtained by slightly changing V1 by dV1 on the basis of I'1=dI1/dV1, and the emission current value I2 associated with V2 and the differential coefficient I'2 are similarly obtained.

Secondly, assuming that f(V) in (Expression 7) associated with each applied voltages V1 or V2 are I1 or I2 and f'(V) is I'1 or I'2, the values calculated from (Expression 7) are compared. Here, V1 is adopted as a preliminary drive voltage (which will be referred to as Vpre hereunder) and V2 is employed as a regular drive voltage (which will be referred to as Vdr hereinafter), if the relationship represented by, e.g., the following expression is obtained:

$$I1/(V1\times I'1-2\times I1)>I2/(V2\times I'2-2\times I2) \quad \text{(Expression 8)}$$

namely, $$f(V1)/\{V1\times f'(V1)-2f(V1)\}>f(V2)/\{V2\times f'(V2)-2f(V2)\} \quad \text{(Expression 1)}$$

On the contrary, V2 is adopted as a preliminary drive voltage (which will be referred to as Vpre hereinafter) and V1 is employed as a regular drive voltage (which will be referred to as Vdr hereunder), if the relationship represented by the following expression can be obtained:

$$I1/(V1\times I'1-2\times I1)<I2/(V2\times I'2-2\times I2) \quad \text{(Expression 9)}$$

Although it is desirable to perform the preliminary drive until the electric field intensity during driving is stabilized, it has discovered that continuation of the preliminary drive until the relative rate of change of the electric field intensity during the preliminary drive becomes not more than 5% can cause the rate of change of the electric field intensity to be within 5% even if the subsequent driving is carried out, thereby sufficiently realizing the effect of the preliminary drive. Therefore, based on (Expression 7), the preliminary drive should be performed until the rate of change of the value represented by the following expression becomes within 5%:

$$f(V1)/\{V1\times f'(V1)-2f(V1)\} \quad \text{(Expression 2)}$$

During the preliminary drive, it is preferable to apply the voltage while monitoring the rate of change of the electric field intensity in the preliminary drive. The pulse voltage can be preferably used as the preliminary drive voltage. For example, the voltage can be applied while calculating the rate of change of the electric field intensity in the pulse discontinued time (interval between application of the pulse voltage and application of the next pulse voltage), and application of the voltage can be stopped when the rate of change becomes within 5%.

In order to be aware of the rate of change in the electric field intensity during the preliminary drive, for example, the following method can be used. During the preliminary drive, the preliminary drive voltage V1 and another voltage V12 which differs from V1 by a minute voltage dV1 are continuously applied, and the electric currents I1 and I12 which flow when the respective voltages are applied and a difference dI1 between I1 and I12 are obtained. Here, since f'(V1)=dI1/dV1 and f(V1)=I1 based on (Expression 5), f(V1)/{V·f'(V1)−2f(V1)} can be expressed as follows:

$$Epre=I1/(V1\cdot dI1/dV1-2I1) \quad \text{(Expression 10)}$$

The rate of change in the electric field intensity can be represented as a rate of change in the value of Epre.

Figure 19A:
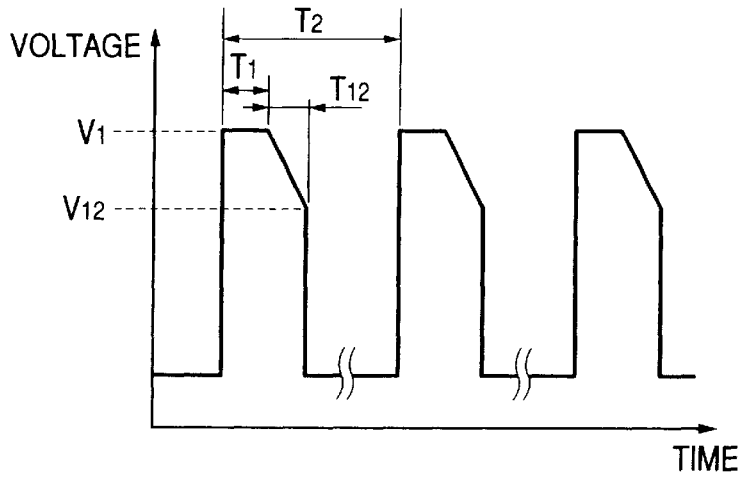
FIGS. 19A, 19B and 19C are views showing a voltage waveform used in the preliminary drive according to the embodiment of the present invention.
Figure 19B:
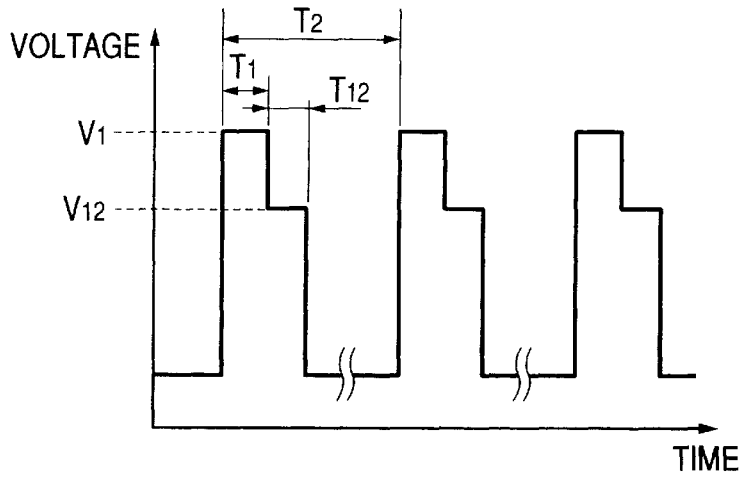
Figure 19C:
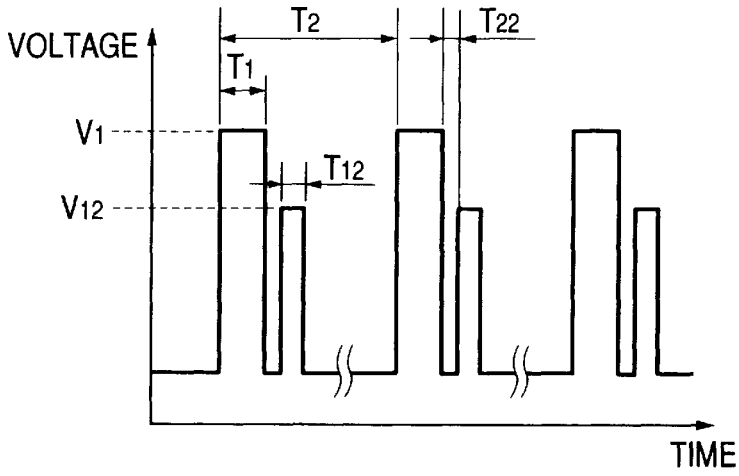

As a voltage waveform in the preliminary drive, the voltage waveform such as shown in FIGS. 19A, 19B and 19C can be used. FIG. 19A shows a voltage waveform of a voltage which changes to the voltage V12 over the time T12 immediately after applying the preliminary drive voltage V1 for the time T1. FIG. 19B shows a voltage waveform obtained when the voltage V12 is applied for the time T12 immediately after applying the preliminary drive voltage V1 for the time T1. Further, FIG. 19C shows a voltage waveform obtained when the voltage V12 is applied for the time T12 after applying the preliminary drive voltage V1 for the time T1. Based on the current value in the respective applied voltages V1 and V12, a rate of change in the value Epre may be obtained to perform the preliminary drive until this rate of change become not more than 5%.

Additionally, in the electron-emitting device corresponding to (Expression 8), to which the stabilization operation is applied, the device current If and the emission current le has the MI characteristic with respect to the device voltage Vf and such a property as that the device current If and the emission current le are uniquely determined with respect to the device voltage Vf. Here, the If–Vf characteristic and the Ie–Vf characteristic depend on a maximum voltage Vmax applied after the stabilization operation.

Figure 20A:
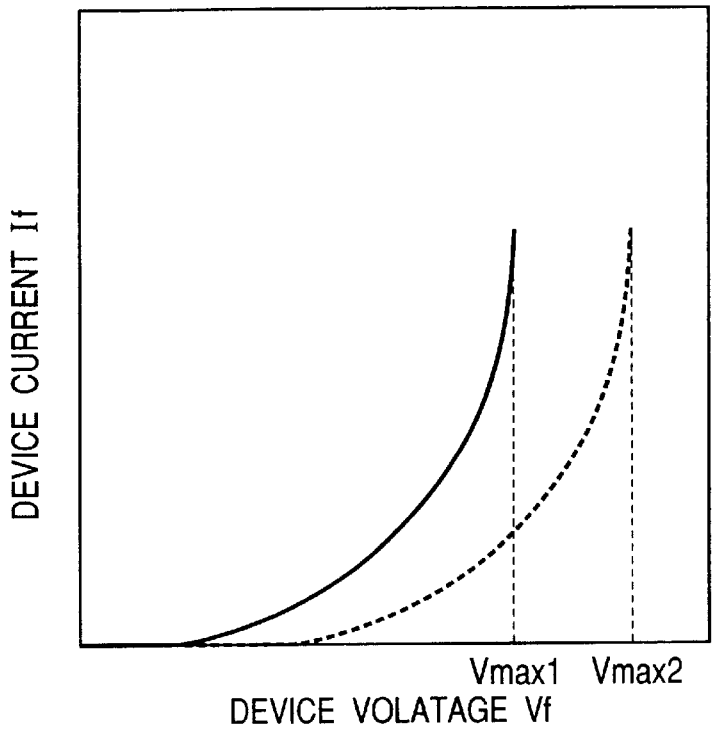
FIGS. 20A and 20B are graphs showing an example of the relationship between a discharge current Ie, a device current If and a device voltage Vf of an electron-emitting device according to the embodiment of the present invention.

Description will now be given as to the I–V characteristic of the electron-emitting device with reference to FIGS. 20A and 20B. FIG. 20A shows the relationship between If and Vf and FIG. 20B shows the relationship between Fe and Vf.

Figure 20B:
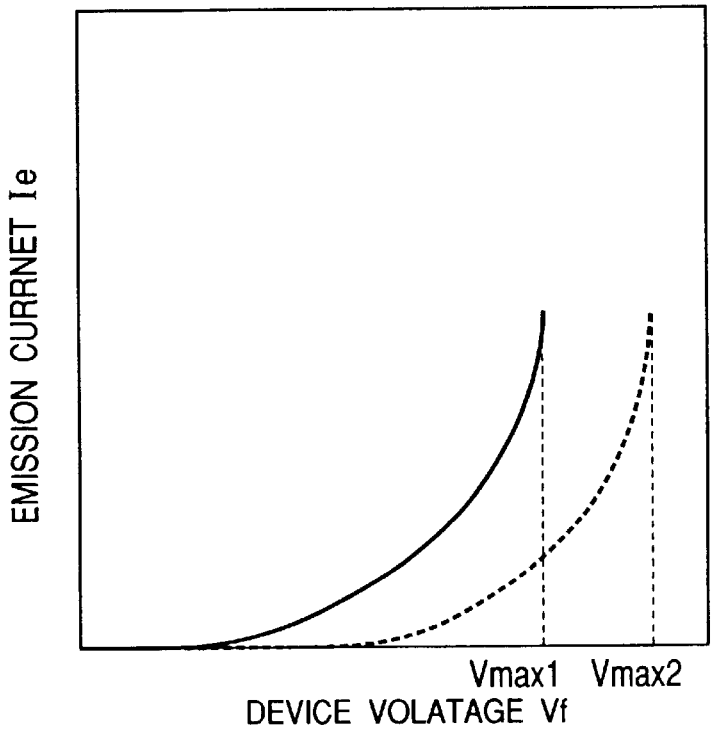

In FIGS. 20A and 20B, a solid line represents the I–V characteristic of the device driven with the maximum Vmax=Vmax1. When driving this device with the device voltage not more than Vmax1, the device has the I–V characteristic equal to the I–V characteristic represented by this solid line. However, when driving with a voltage Vmax2 not less than Vmax1, the device demonstrates a different I–V characteristic as indicated by a broken line in the drawing. When driving this device with a device voltage not more than Vmax2, the device has the I–V characteristic equal to the I–V characteristic represented by the broken line. That is because a shape of the electron-emitting region or an electron-emitting area may be changed in accordance with the maximum voltage Vmax applied to the electron-emitting device.

Figure 21:
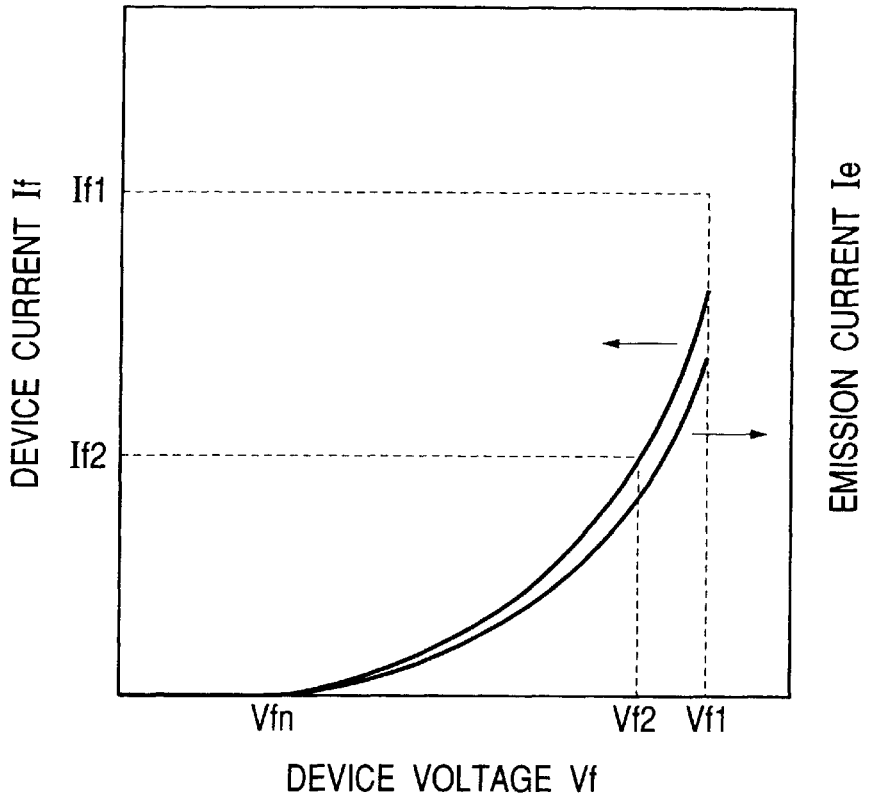
FIG. 21 is a graph showing an example of the relationship between the discharge current Ie, the device current If and the device voltage Vf of the electron-emitting device according to the embodiment of the present invention.
Figure 22:
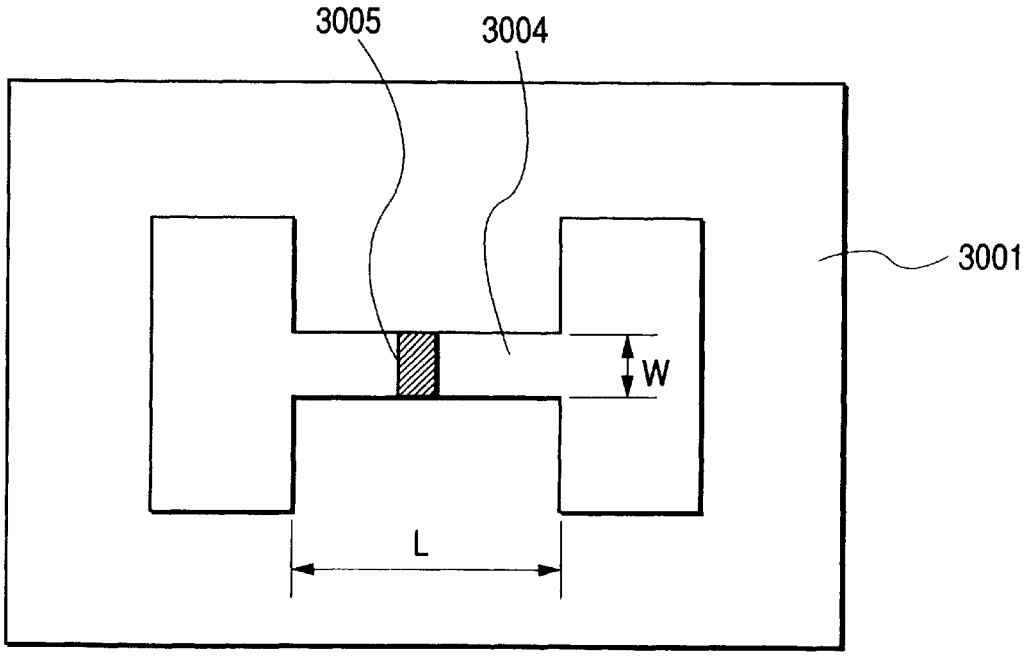
FIG. 22 is a schematic plan view of a surface conduction emission device.
Figure 23:
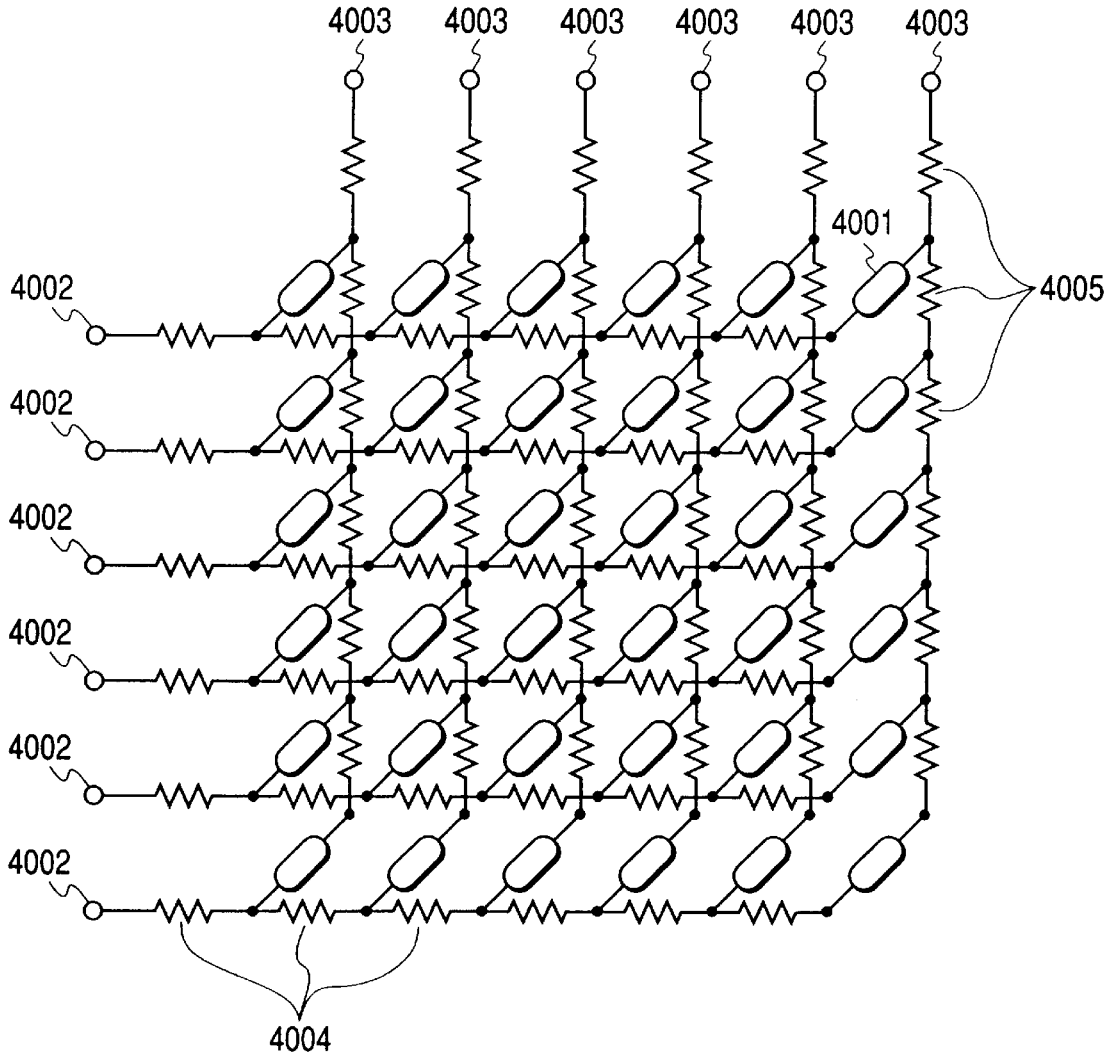
FIG. 23 is a schematic view of an electron source having a simple matrix arrangement.
Figure 24:
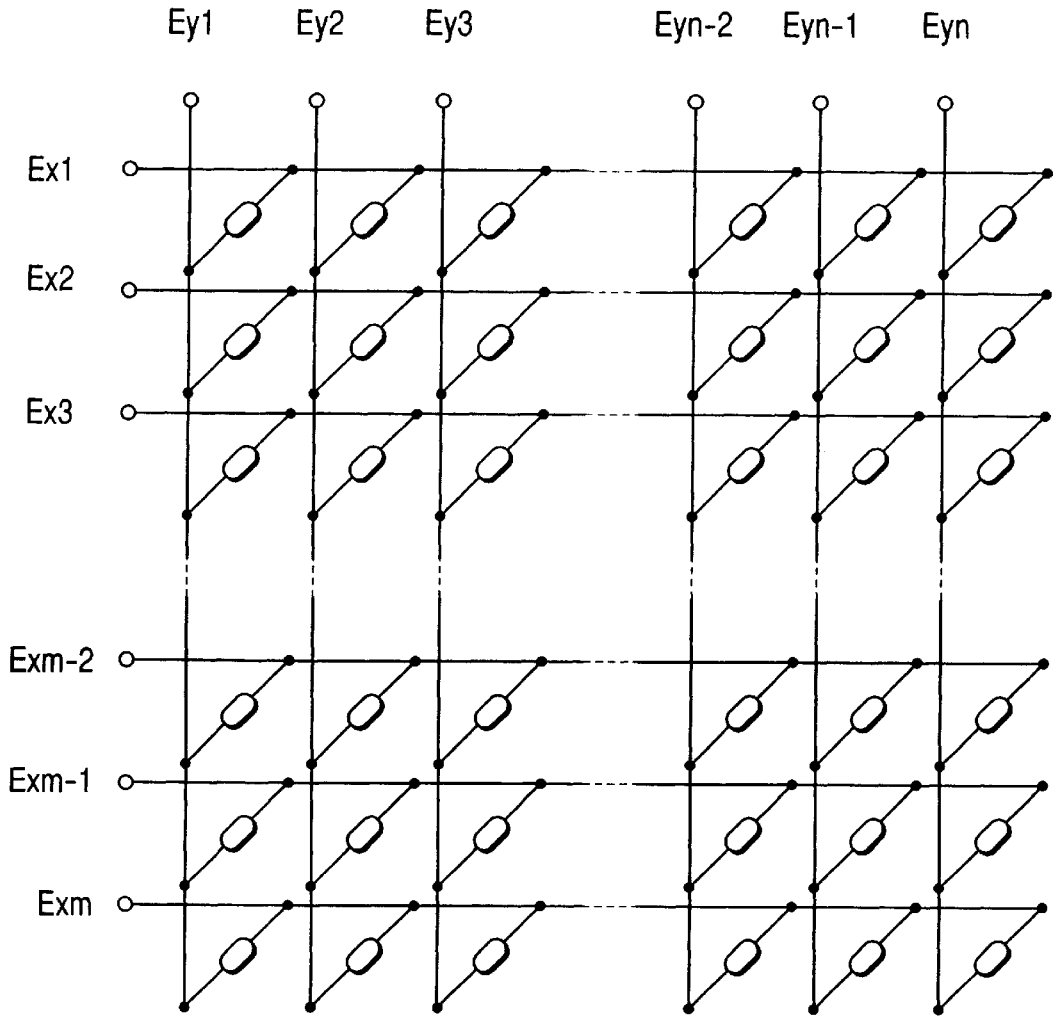
FIG. 24 is an electron-emitting device arrangement plan of an electron source having M rows and N columns to which the present invention can be applied.
Figure 25:
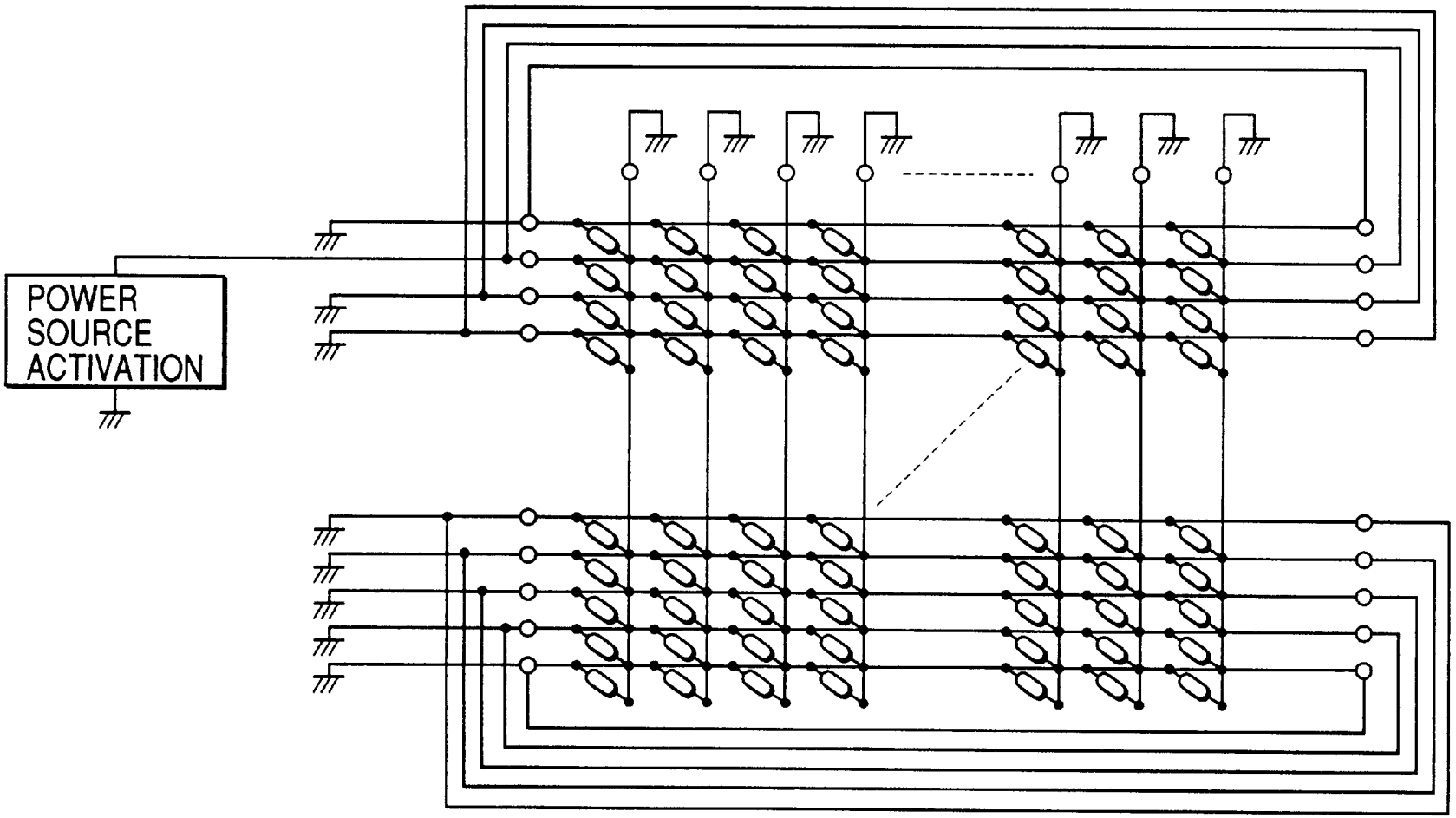
FIG. 25 is an explanatory diagram showing the state of energization activation to which the present invention can be applied.
Figure 26:
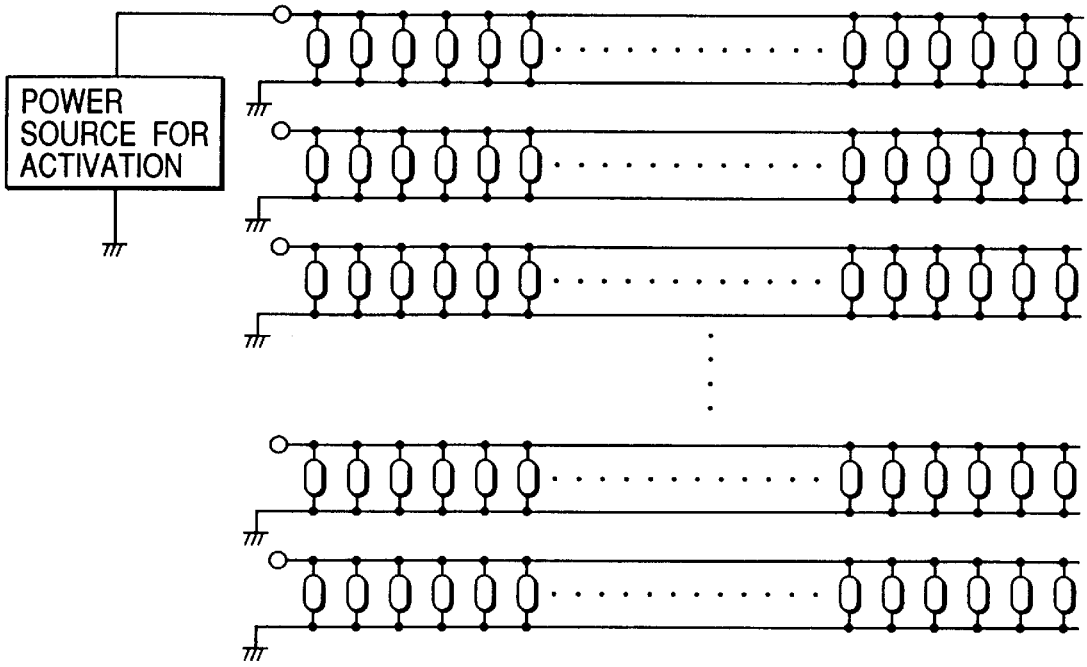
FIG. 26 is a block diagram showing a multi-surface conduction electron-emitting device substrate having the ladder-like wiring to which the present invention can be applied.

When the device is subjected to the preliminary drive by using the device voltage V1 in the preliminary drive process, the electron-emitting device has the If–Vf characteristic and the Ie–Vf characteristic which are uniquely determined by the voltage Vmax=V1 as shown in FIG. 21.

Subsequently, the device current obtained with the device voltage Vf1 upon completion of the preliminary drive is determined as If1, and Vf2 with which If2≦0.7If1 is obtained based on the If–Vf characteristic determined by the preliminary drive is selected as a drive voltage (Vf2 in FIG. 21). When the drive voltage with which If2≦0.7If1 is obtained is determined, reduction in the discharge current can be suppressed for a long period of time.

Since it can be considered that a change in shape or discharge area of the electron-emitting region hardly occurs even if the drive voltage Vf2 which causes If2≦0.7If1 is applied to the device subjected to the preliminary drive with the device voltage Vf1 as described above, the device current If lower than that during the preliminary driving is used to perform the driving while assuring the discharge area substantially equal to that during the preliminary driving. Therefore, the current density of the device current flowing through the electron-emitting region during the driving can be lowered, which can suppress the thermal deterioration of the electron-emitting region and enable the stable electron emission for a long time.

The preliminary driving can be carried out for a necessary period of time when driving with the voltage lower than the preliminary drive voltage after the preliminary driving because the If–Vf characteristic and the Ie–Vf characteristic of the electron-emitting device hardly change, and the preliminary driving can be effected by applying the pulse voltage having the pulse width of several μsec to several score msec, or more preferably 10 μsec to 10 msec for several pulses to several score pulses or more.

Incidentally, if there is the relationship such as represented by (Expression 9) in the voltage of V1>V2, the regular drive voltage Vdr is higher than the preliminary drive voltage Vpre, and the further high electric field intensity is generated in the electron-emitting emitting region (which will be referred to as the electron-emitting region A) changed by using the voltage Vpre when the voltage Vdr is applied. However, the main electron-emitting source which influences the electron emission amount at this time is a different electron-emitting region (which will be referred to as the electron-emitting region B), and the contribution of the electron-emitting region A to the entire emission current is small. The preliminary driving is effective even in the above-described relationship, and application of the voltage Vpre in advance can previously reduce the factors for causing the large fluctuation of the electron-emitting region A, thereby preventing the subsequent destructive fluctuation of the drive voltage Vdr from occurring.

The preliminary driving method described above is also effective to the any electron-emitting device other than the FE electron-emitting device or the surface conduction electron-emitting device, for example, the MIM electron-emitting device.

When manufacturing the electron source having a plurality of electron-emitting devices such as a multi-electron source in which plural surface conduction electron-emitting devices are wired in the simple matrix form, it is desirable to perform the preliminary drive operation with respect to all the devices constituting the electron source prior to the driving.

[Embodiment 1]

Before explaining the apparatus and the method for activation which take a leading part of the present invention, the structure and the manufacturing method of a display panel of an image-displaying apparatus to which the present invention is applied will be first described with reference to a concrete example.

Figure 6:
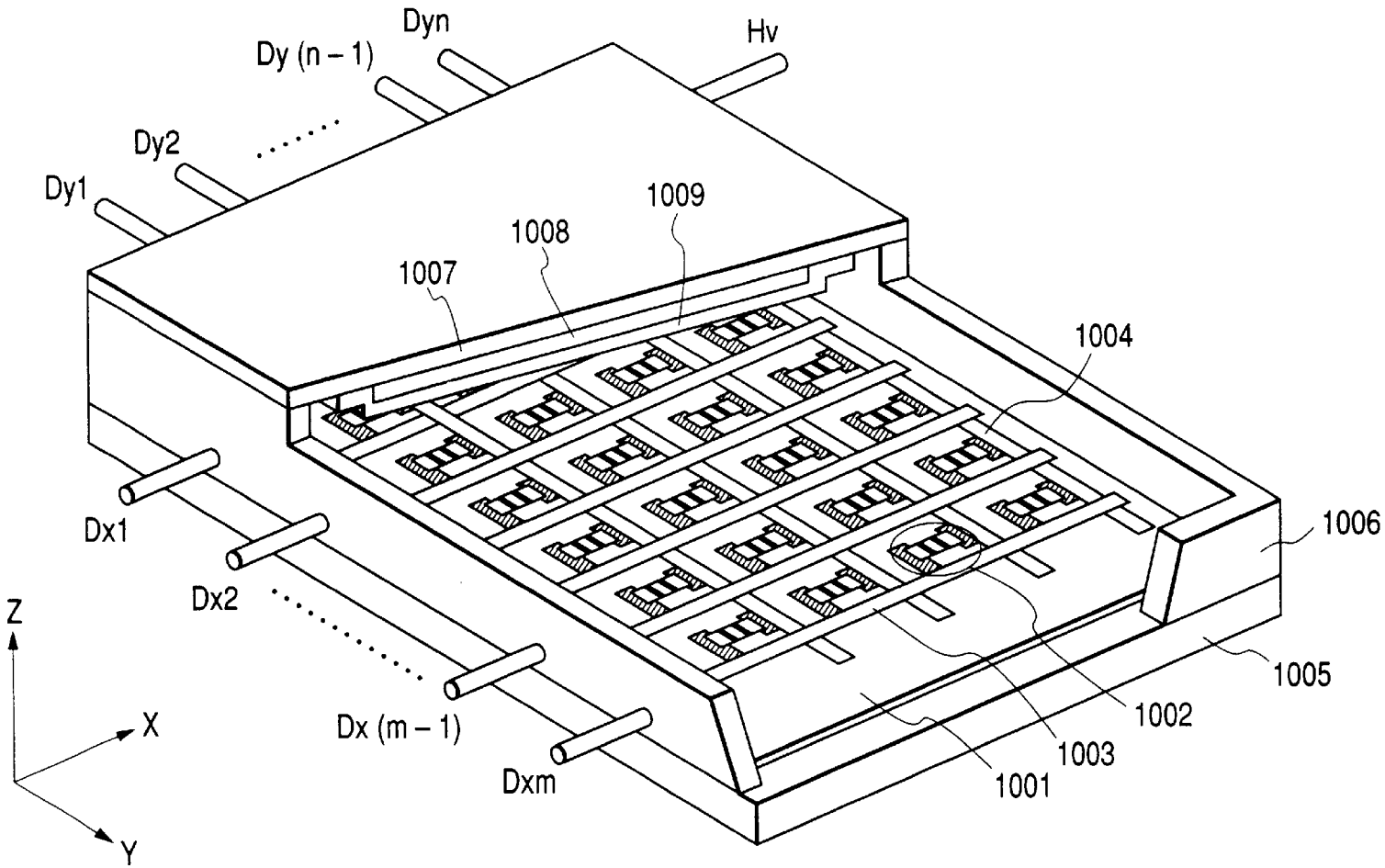
FIG. 6 is a partially cutaway perspective view showing a display panel to which the present invention can be applied.

FIG. 6 is a perspective view of a display panel used in the embodiment, and a part of the panel is shown in the cutaway manner in order to illustrate the internal structure. In the face view, reference numeral 1005 denotes a rear plate; 1006, a side wall; and 1007, a face plate. These members 1005 to 1007 form an airtight chamber for maintaining the inside of the display panel in a vacuum. When assembling the airtight chamber, although sealing is required for assuring the sufficient strength and the airtightness at the joining portions of the respective members, for example, frit glass is applied to the joining portions after the forming activation of the rear plate according to the later-described method and these portions are baked at 400 to 500° C. centigrade for more than 10 minutes, thereby achieving the sealing. The method for evacuating the inside of the airtight chamber for obtaining the vacuum state will be described later.

A substrate 1001 is fixed to the rear plate 1005, and N×M cold cathode devices 1002 are formed on the substrate. N and M are positive integers not less than 2 and appropriately set in accordance with a number of pixels which are targets of display. For example, in the display apparatus which is intended to perform display of a high-definition television, it is desirable to set numbers equal to or above N=3000 and M=1000. Further, in a regular television, pixels whose number is approximately a half of the above number are required, and N=3072 and M=480 are set in this embodiment. These pixels are allocated in accordance with a screen size of 16:9, and a ratio of a pitch between the row-directional wiring to a pitch between the column-directional wiring then becomes 3.6:1.

The N×M cold cathode devices are wired in the form of a simple matrix by using the M row-directional wiring 1003 and the N column-directional wiring. The portion constituted by the members 1001 to 1004 is referred to as a multi-electron source. Incidentally, the manufacturing method or the structure of the multi-electron source will be described in detail hereinafter.

Although the substrate 1001 of the multi-electron source is fixed to the rear plate 1005 of the airtight chamber in this embodiment, if the substrate 1001 of the multi-electron source has the sufficient strength, the substrate 1001 itself of the multi-electron source can be used as the rear plate of the airtight chamber.

Figure 7A:
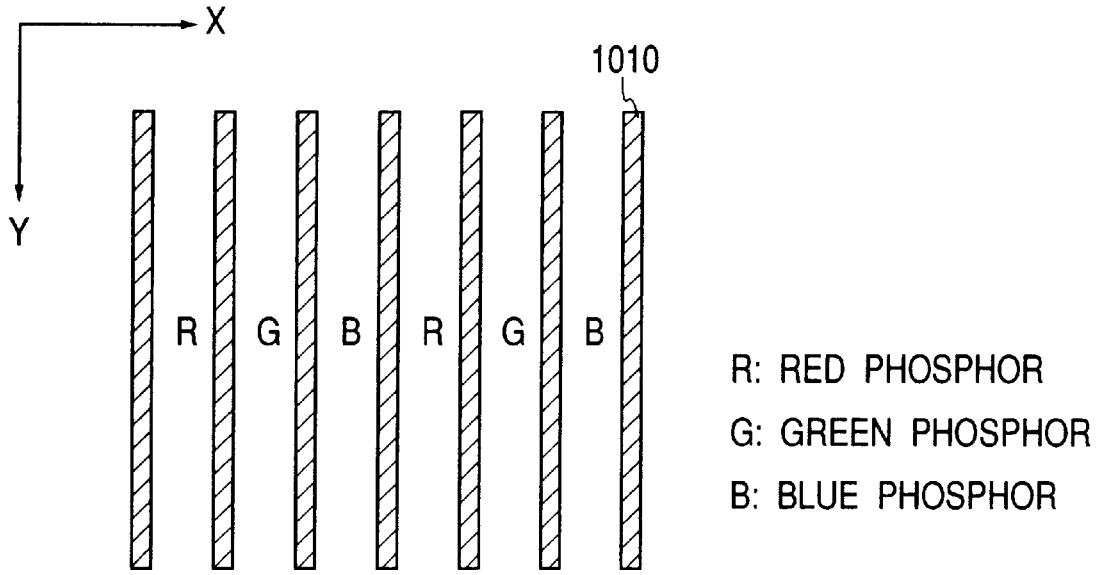
FIGS. 7A and 7B are views showing the arrangement of a phosphor and a black conductor used in the display panel to which the present invention can be applied.

A fluorescent screen 1008 is formed on a bottom surface of the face plate 1007. Since this embodiment provides a color display apparatus, phosphors having three primary colors, i.e., red, green and blue which are used in the field of a CRT are separately applied to the fluorescent screen 1008. The phosphors having the respective colors are separately applied in the form of, e.g., stripes as shown in FIG. 7A, and a black conductor 1010 is provided between the stripes of the phosphors. The black conductor 1010 is provided in order to prevent the drift of the displayed color from occurring even if an irradiation position of an electron beam is slightly displaced, prevent the display contrast from being reduced by avoiding the reflection of an external light ray, or prevent the charging up of the fluorescent screen due to an electron beam. Although black lead is used as a main component in the black conductor 1010, any material other than this may be used if the above object can be attained.

Figure 7B:
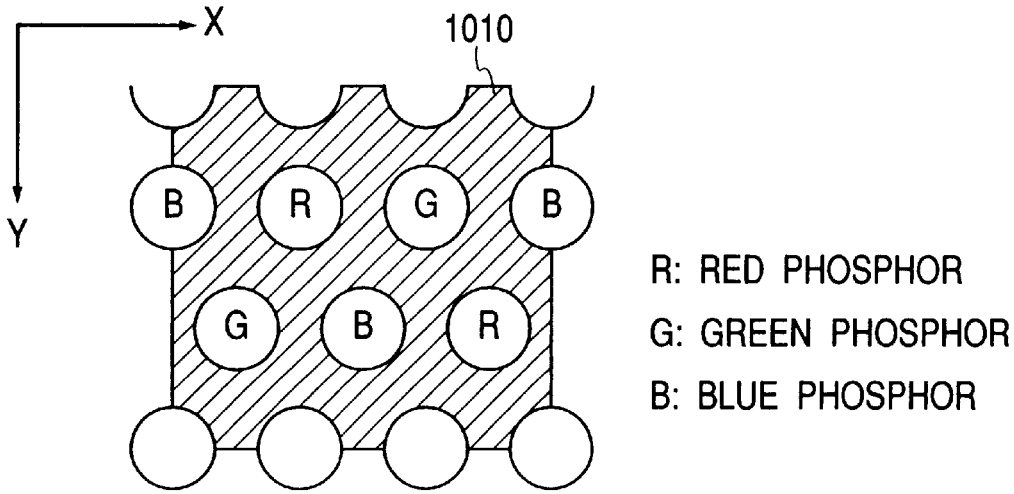

Further, application of the phosphors having the three primary colors is not restricted to the allocation in the stripe form shown in FIG. 7A, a delta-like allocation shown in FIG. 7B or any other allocation may be employed for example.

In case of creating a monochrome display panel, a monochromatic fluorescent material can be used for the fluorescent screen 1008, and the black conductor material does not have to be used.

In addition, a metal back 1009 which is known in the field of CRT is provided on the surface of the fluorescent screen 1008 on the rear plate side. The metal back 1009 is provided for the purpose of improvement of the light availability by specular-reflecting a part of light rays emitted from the fluorescent screen 1008, protection of the fluorescent screen 1008 from the collision of negative ions, realization of a function of the metal back as an electrode for applying an electron beam accelerating voltage, or realization of a function of the fluorescent screen 1008 as a conducting path for the excited electrons. The metal back 1009 is formed by a method in which the fluorescent screen surface is subjected to the smoothing operation after forming the fluorescent screen 1008 on the face plate substrate 1007 and A1 is vacuum-evaporated on that surface. It is to be noted that the metal back 1009 is not necessary when a phosphor material for a low voltage is used for the fluorescent screen 1008.

Although not used in this embodiment, a transparent electrode using, e.g., ITO as its material may be provided between the face plate substrate 1007 and the fluorescent screen 1008 in order to apply the accelerating voltage or improve the conductivity of the fluorescent screen.

Reference characters Dx1 to Dxm and Dy1 to Dyn and Hv denote terminals for electrical connection terminals having the airtight structure provided for establishing the electrical connection between the display panel and a non-illustrated electric circuit.

The terminals Dx1 to Dxm are electrically connected to the row-directional wiring 1003 of the multi-electron source; the terminals Dy1 to Dyn, the column-directional wiring 1004 of the multi-electron source; and the terminal Hv, the metal back 1009 of the face plate.

In order to evacuate the airtight chamber for obtaining the vacuum state, a non-illustrated evacuation pipe is connected to the vacuum pump after assembling the airtight chamber, and the airtight chamber is evacuated until a degree of vacuum of approximately $10^{-7}$ [Torr] is obtained. Thereafter, although the evacuation pipe is sealed, a getter film (not shown) is formed at a predetermined position in the airtight chamber immediately before the sealing or after the sealing in order to maintain the degree of vacuum in the airtight chamber. The getter film is a film formed by heating and evaporating a getter material having, e.g., Ba as a main component by a heater or high-frequency heating, and the absorption of the getter film can maintain the degree of vacuum in the airtight chamber to $1\times10^{-5}$ or $1\times10^{-7}$ [Torr].

The above has described the basic structure and the manufacturing method of the display panel according to the embodiment of the present invention.

The manufacturing method of a multi-electron source used in the display panel according to the above embodiment will now be explained. If the multi-electron source used in an image-displaying apparatus according to the present invention is an electron source in which the cold cathode devices are wired in the form of a simple matrix, a material, a shape or a manufacturing method of the cold cathode devices are not restricted to certain types. Therefore, it is possible to use the cold cathode device such as the surface conduction electron-emitting device, the FE device or the MIM device.

However, if an inexpensive display apparatus having a large display screen is desired, the surface conduction electron-emitting device is particularly preferable in these cold cathode devices. That is, since the relative position or shape of an emitter cone and a gate electrode largely affects the electron-emitting characteristic in the FE device, the manufacturing technique with the extremely high accuracy is required, which is a disadvantageous factor for attaining the large area or reduction in the manufacturing cost. Further, the film thicknesses of an insulation layer and an upper electrode must be thinned and uniformized in the MIM device, which also becomes a disadvantageous factor for attaining the large area and reduction in the manufacturing cost. On that point, the manufacturing method of the surface conduction electron-emitting device is relatively simple, and hence realization of the large area or reduction in the manufacturing cost can be facilitated. Additionally, the inventors have found that, among the surface conduction electron-emitting devices, the device in which the electron-emitting region or its peripheral region is formed by a fine grain film is particularly superior in the electron-emitting characteristic and its production can be facilitated. Accordingly, use of the multi-electron source for the image-displaying apparatus having the high brightness and the large screen is most preferable. Thus, the surface conduction electron-emitting device in which the electron-emitting device or its peripheral region is formed by a fine grain film is used in the display panel according to the above embodiment. The basic structure, the manufacturing method and the characteristic of the preferred surface conduction electron-emitting device will be first explained, and description will be subsequently given on the structure of the multi-electron source in which a plurality of the devices are wired in a simple matrix.

(Preferred Device Structure and Manufacturing Method of Surface Conduction Electron-emitting Device)

As a typical structure of the surface conduction electron-emitting device in which the electron-emitting region or its peripheral region is formed by a fine grain film, there are the following two types of device, i.e., a plane type device and a step type device.

(Plane Type Surface Conduction Electron-emitting Device)

Figure 8A:
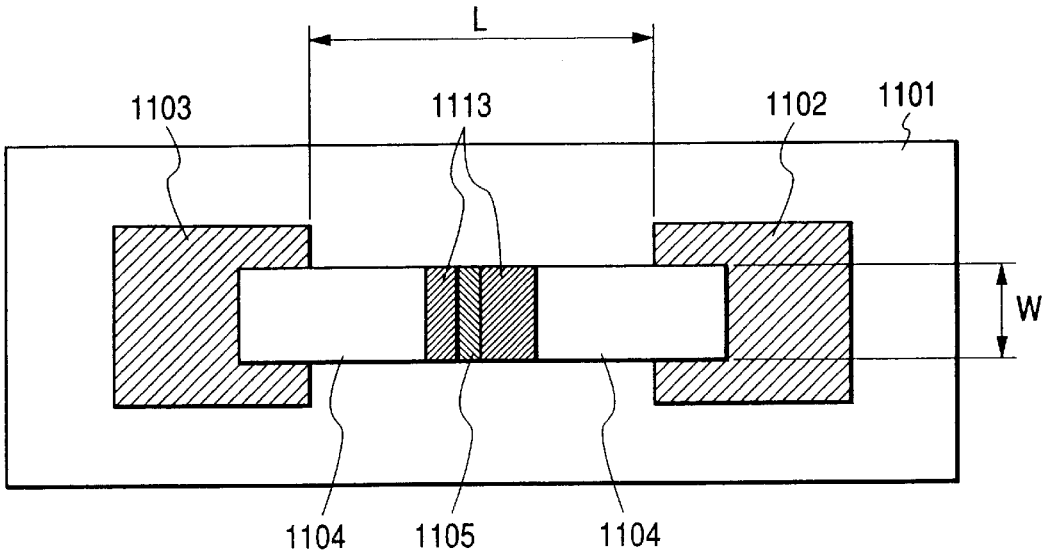
FIGS. 8A and 8B are a schematic plan view and a cross-sectional view showing a plane type surface conduction emission device to which the present invention can be applied.
Figure 8B:
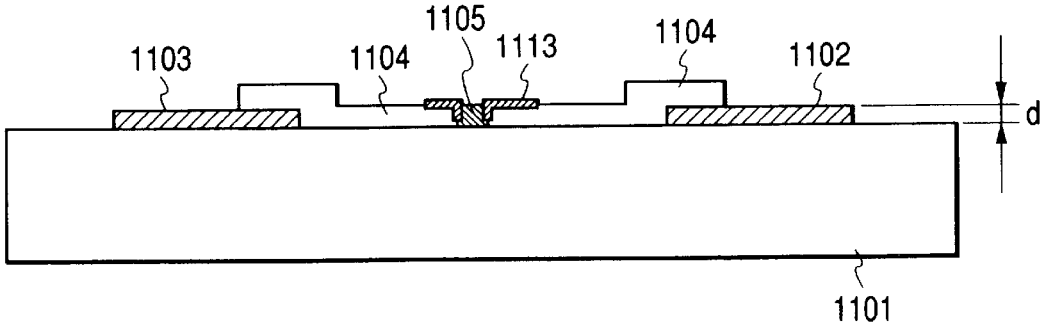

Firstly, the device structure and the manufacturing method of the plane type surface conduction electron-emitting device will be described. FIGS. 8A and 8B are a plan view (FIG. 8A) and a cross-sectional view (FIG. 8B) for explaining the structure of the plane type surface conduction electron-emitting device. In the drawing, reference numeral 1101 designates a substrate; 1102 and 1103, device electrodes; 1104, an electroconductive thin film; 1105, an electron-emitting region formed by the energization forming operation; and 1113, a thin film formed by the energization activation operation.

As the substrate 1101, it is possible to employ various kinds of glass substrate such as quartz glass or soda lime glass substrates, various ceramics substrates consisting of, e.g., alumina, a substrate obtained by laminating an insulation layer having, e.g., $SiO_2$ as its material on these various kinds of substrate, or others.

Further, the device electrodes 1102 and 1103 provided on the substrate 1101 so as to be opposed to each other and parallel to the substrate surface are formed by a material having the conductivity. For example, an appropriate material can be selected from metals such as Ni, Cr, Au, Mo, W, Pt, Ti, Cu, Pd, Ag and the like, alloys of these metals, metal oxides such as $In_2O_3$—$SnO_2$, a semiconductor such as polysilicon and the like. In case of forming the electrode, the formation can be facilitated by the combined use of a film manufacturing technique such as vacuum evaporation and a patterning technique such as photolithography and etching, but any other method (for example, a printing technique) may be used for the formation.

The shape of the device electrodes 1102 and 1103 is appropriately designed in accordance with an application object of the electron-emitting device. In general, an electrode gap L is usually designed by selecting an appropriate value from a range of several hundred angstrom to several score micrometer, and a range of several micrometer to several score micrometer is particularly preferable for application to the display apparatus. Further, as to a thickness d of the device electrode, an appropriate value is selected from a range of several hundred angstrom to several micrometer.

A fine grain film is used for the electroconductive thin film 1104. The fine grain film described herein means a film (including an island-shaped aggregate) containing multiple fine particles as constituent elements. When microscopically examining the fine grain film, a structure in which the individual fine particles are estranged from each other, or a structure in which the fine particles are adjacent to each other, or a structure in which the fine particles overlap one on another can be observed. The particle size of the fine particle used in the fine grain film may be in a range of several angstrom to several thousand angstrom, and a range of 10 angstrom to 200 angstrom is particularly preferable. Further, the film thickness of the fine grain film is appropriately set taking into account the following various conditions. That is, these are a condition required for establishing the excellent electrical connection between the device electrodes 1102 and 1103, a condition required for excellently performing the later-described energization forming, a condition required for setting the electric resistance of the fine grain film itself to a later-described appropriate value, and others.

Concretely, the film thickness is set in a range of several angstrom to several thousand angstrom, and a range from 10 angstrom to 500 angstrom is most preferable. As a material which can be used for forming the fine grain film, there are, for example, metals such as Pd, Pt, Ru, Ag, Au, Ti, In, Cu, Cr, Fe, Zn, Sn, Ta, W, Pb and the like, oxides such as PdO, $SnO_2$, $In_2O_3$, PbO, $Sb_2O_3$ and the like, borides such as $HfB_2$, $ZrB_2$, $LaB_6$, $CeB_6$, $YB_4$, $GdB_4$ and the like, carbides such as TiC, ZrC, HfC, TaC, SiC, WC and the like, nitrides such as TiN, ZrN, HfN and the like, a semiconductor such as Si, Ge and the like, carbon and others, and an appropriate material is selected from them.

As described above, although the electroconductive thin film 1104 is formed by a fine grain film, a sheet resistance value is set to be within a range of $10^3$ to $10^7$ [ohm/sq].

Incidentally, since it is desirable to electrically connect the electroconductive thin film 1104 to the device electrodes 1102 and 1103, such a structure as that they partially overlap one on another is adopted. As to the overlap, although the substrate, the device electrodes and the electroconductive thin film are laminated in the mentioned order in FIGS. 8A and 8B, the substrate, the electroconductive thin film and the device electrodes may be laminated in the mentioned order.

Further, the electron-emitting region 1105 is a fissure-like region formed in a part of the electroconductive thin film 1104 and has an electrical characteristic of resistance higher than that of the electroconductive thin film therearound. The fissure is formed by performing the later-described energization forming operation. The fine particles having a particle size of several angstrom to several hundred angstrom may be provided in the fissure. Incidentally, since a position or a shape of the actual electron-emitting region is hard to be accurately and correctly illustrated, it is typically shown in FIGS. 8A and 8B. Further, a thin film 1113 is composed of carbon or carbon compound and covers the electron-emitting region 1105 or its vicinity. The thin film 1113 is formed by effecting the later-described energization activation operation after the energization forming operation.

The thin film 1113 consists of any of monocrystal graphite, polycrystal graphite and amorphous carbon or a mixture of them, and its film thickness is not more than 500 [angstrom] or more preferably 300 [angstrom].

Incidentally, a position or a shape of the actual thin film 1113 is hard to be accurately illustrated, and hence it is typically shown in FIGS. 8A and 8B. The plan view (FIG. 8A) shows the device in which a part of the thin film 1113 is omitted.

Although the above has described the basic structure of the preferred device, the following device is used in the embodiment.

That is, soda lime glass is used for the substrate 1101, and an Ni thin film is used for the device electrodes 1102 and 1103. A thickness d of the device electrode is 1000 [angstrom] and a gap between the electrodes L is 2 [micrometer]. Pd or PdO is used as a main material of the fine grain film, and a thickness and a width W of the fine grain film are determined to be approximately 100 [angstrom] and 100 [micrometer], respectively.

A preferred method for manufacturing a plane type surface conduction electron-emitting device will now be described. FIGS. 9A to 9E are cross-sectional views for explaining the manufacturing steps of the surface conduction electron-emitting device, and reference numerals denoting the respective constituent parts are same with those in FIGS. 8A and 8B.

Figure 9A:
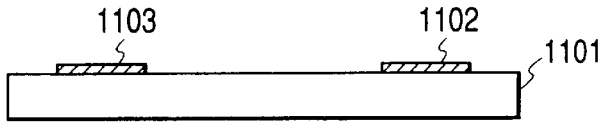
FIGS. 9A, 9B, 9C, 9D and 9E are views showing a process for manufacturing an electron-emitting device illustrated in FIGS. 8A and 8B.

1) As shown in FIG. 9A, the device electrodes 1102 and 1103 are formed on the substrate 1101. Before forming the device electrodes, the substrate 1101 is sufficiently cleaned by using a cleaner, pure water and an organic solvent, and a material of the device electrodes is then deposited. As a deposition method, a vacuum film formation technique such as an evaporation method or a spattering method may be used for example. Thereafter, the deposited electrode material is patterned by using a photolithography/etching technique in order to form a pair of device electrodes (1102 and 1103) shown in FIG. 9A.

Figure 9B:
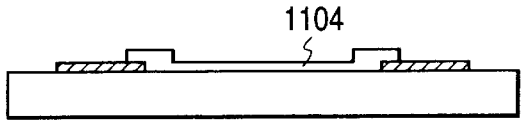

2) As shown in FIG. 9B, the electroconductive thin film 1104 is then formed.

Before forming, an organic metal liquid solution is applied to the substrate shown in FIG. 9A and dried. A heat burning operation is subsequently performed to form the fine grain film, the photolithography/etching method is then used for patterning in order to obtain a predetermined shape. Here, the organic metal liquid solution means a liquid solution of an organic metal compound having a material of the fine particles used for the electroconductive thin film as a main element. Concretely, Pd is used as a main element in this embodiment. Further, although a dipping method is used as a coating method, any other method such as a spinner method or a spray method may be used.

In addition, as a method for forming the electroconductive thin film composed of the fine grain film, a method other than application of the organic metal liquid solution employed in this embodiment, e.g., a vacuum evaporation method, a spattering method or a chemical vapor phase deposition method may be used.

Figure 9C:
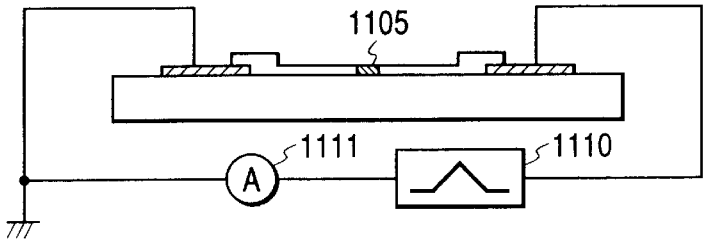

3) As shown in FIG. 9C, an appropriate voltage is then applied between the device electrodes 1102 and 1103 from the power supply for forming 1110, and the energization forming operation is conducted to form the electron-emitting region 1105.

The energization forming operation means an operation by which the electroconductive thin film 1104 composed of the fine grain film is energized and partially fractured, deformed or transformed in the adequate manner in order to obtain the structure suitable for effecting the electron emission. In a part whose structure is changed to be preferable for effecting the electron emission (namely, the electron-emitting region 1105) in the electroconductive thin film composed of the fine grain film, a fissure suitable for the thin film is formed. Incidentally, comparing this part with that before forming the electron-emitting region 1105, the electric resistance measured between the device electrodes 1102 and 1103 can be greatly improved after forming the electron-emitting region 1105.

Figure 10:
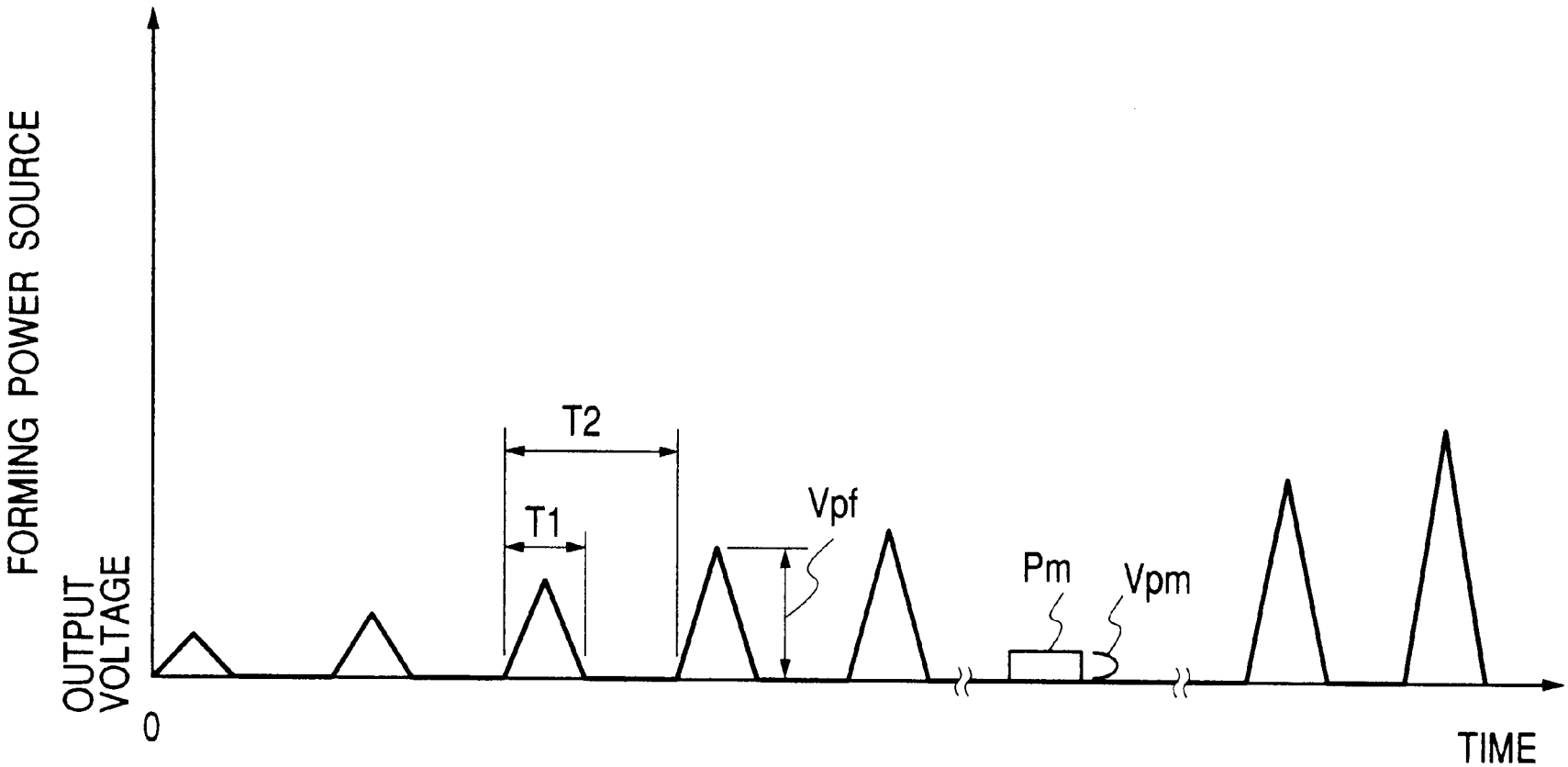
FIG. 10 is a view showing a voltage pulse used in a forming operation in the manufacturing process depicted in FIGS. 9A, 9B, 9C, 9D and 9E.

In order to explain the energization method in detail, FIG. 10 shows an example of a waveform of an appropriate voltage applied from the power supply for forming 1110. In case of forming the electroconductive thin film composed of the fine grain film, a pulse-type voltage is preferable, and a triangular pulse having a pulse width T1 is continuously applied at a pulse separation T2 in this embodiment as shown in the drawing. In this case, a wave height value Vpf of the triangular pulse is sequentially boosted. Further, a monitor pulse Pm for monitoring the state of forming the electron-emitting region 1105 is inserted between the triangular pulses at appropriate intervals, and an electric current flowing in this sate is measured by an ampere meter 1111.

In this embodiment, assuming that, for example, the pulse width T1 is 1 [millisecond] and the pulse separation T2 is 10 [milliseconds] in the vacuum atmosphere of, e.g., $10^{-5}$ [Torr], the wave height value Vpt is boosted in 0.1 [V] increments in accordance with each one pulse. Further, the monitor pulse Pm is inserted once every time five pulses of the triangular wave are applied. The voltage Vpm of the monitor pulse is set to 0.1 [V] so as not to adversely affect the forming operation. When the electric resistance between the device electrodes 1102 and 1103 becomes $1\times10^{6}$ [ohm], i.e., when the electric current measured by the ampere meter 1111 becomes not more than $1\times10^{-7}$ [A] during application of the monitor pulse, the energization associated with the forming operation is terminated.

The above method is a preferred method relating to the surface conduction electron-emitting device according to this embodiment, and it is preferable to adequately change the energization condition when, for example, a material or a film thickness of the fine grain film is changed or the design of the surface conduction electron-emitting device such as the gap between the device electrodes L is changed.

Figure 9D:
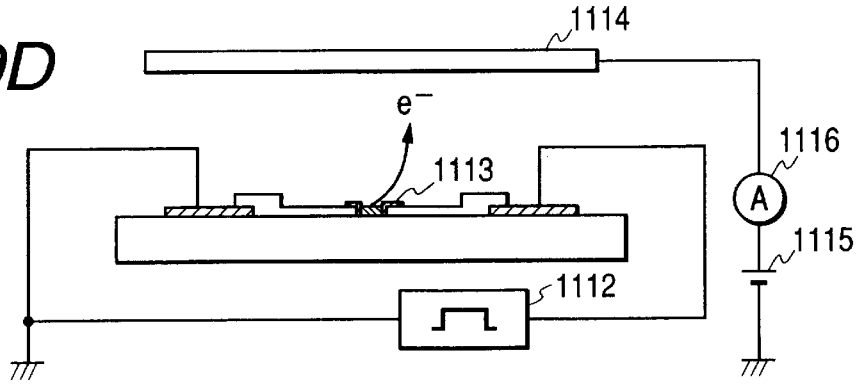

4) As shown in FIG. 9D, an appropriate voltage is applied between the device electrodes 1102 and 1103 from the power supply for activation 1112 and the energization activation operation is carried out to improve the electron-emitting characteristic.

The energization activation operation means such an operation as that the electron-emitting region 1105 formed by the energization forming operation is energized under an appropriate condition and carbon or carbon compound is deposited in the vicinity of this region. FIGS. 8A and 8B typically show a deposition consisting of carbon or carbon compound as a member 1113. It is to be noted that the emission current obtained under the same application voltage can be typically increased hudredfold or more by carrying out the energization activation operation as compared with the electric current obtained before this operation.

Concretely, periodical application of the voltage pulse in the vacuum atmosphere in a range of $10^{-4}$ to $10^{-5}$ [Torr] causes the carbon or the carbon compound which derives from the organic compound existing in the vacuum atmosphere to be deposited. This atmosphere can be formed by utilizing an organic gas remaining in the atmosphere in case of evacuating the vacuum chamber using an oil diffusion pump or a rotary pump or obtained by leading a gas consisting of an appropriate organic substance in the vacuum which has been once evacuated by, e.g., an ion pump. A preferred organic substance gas pressure in this example can be adequately determined according to circumstances because the gas pressure differs depending on the application pattern, a shape of the vacuum chamber, a type of the organic substance and others.

As the organic substance used herein, there are aliphatic hydrocarbons such as alkane, alkene or alkyne, aromatic hydrocarbons, alcohols, aldehydes, ketons, amines, or organic acids such as carbolic acid, carboxylate, sulfonic acid. Specifically, it is possible to use a saturated hydrocarbon represented as $C_nH_{2n+2}$ such as methane, ethane or propane, an unsaturated hydrocarbon represented by a composition formula like $C_nH_{2n}$ such as ethylene or propylene, benzene, toluene, methanol, ethanol, formaldehyde, acetaldehyde, acetone, methyl ethyl ketone, methylamine, ethylamine, carbolic acid, formic acid, acetic acid, propionic acid and others.

This operation can cause the carbon or the carbon compound to be deposited on the device from the organic substance existing in the atmosphere, and the device current If and the emission current Ie demonstrate the considerable change.

It is to be noted that an inorganic substance such as carbon monoxide (CO) can be used as an activation substance as well as the above-described organic substances. The deposition 1113 is any of monocrystal graphite, polycrystal graphite and amorphous carbon or a mixture of these materials, and its film thickness is not more than 500 [angstrom] or more preferably not more than 300 [angstrom].

Figure 11A:
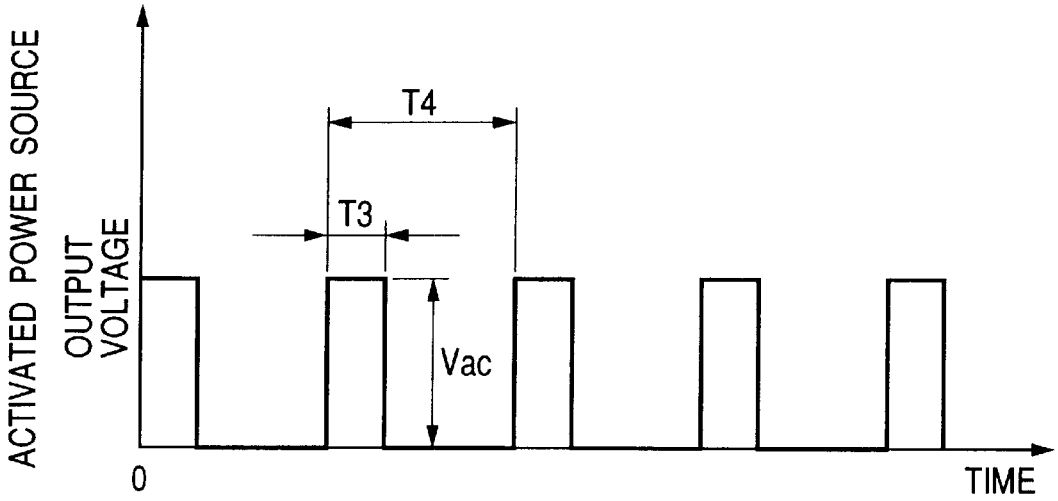
FIGS. 11A and 11B are views showing a voltage pulse used in a preliminary drive process in the manufacturing process of FIGS. 9A, 9B, 9C, 9D and 9E.

For explaining the energization method in detail, FIG. 11A shows an example of a waveform of an appropriate voltage applied from the power supply for activation 1112. Although the energization activation operation is carried out by periodically applying a rectangular wave of a constant voltage in this embodiment, it is determined that: the voltage Vac having a rectangular wave is 14 [V], the pulse width T3 is 1 [millisecond], and the pulse separation T4 is 10 [milliseconds]. The above energization condition is a preferred condition relating to the surface conduction electron-emitting device according to the present embodiment, and it is preferable to appropriately change the condition when the design of the surface condition electron-emitting device is changed.

Figure 11B:
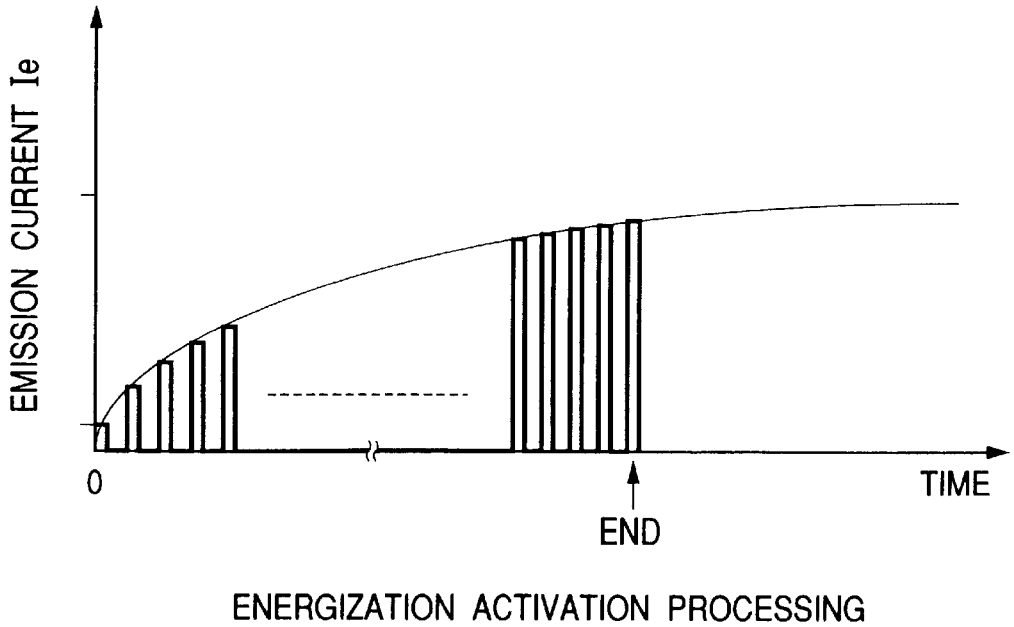

Reference numeral 1114 in FIG. 9D denotes an anode electrode for acquiring the emission current Ie emitted from the surface conduction electron-emitting device, to which are connected a direct-current high-voltage power supply 1115 and an ampere meter 1116. During application of the voltage from the power supply for activation 1112, the emission current Ie is measured by the ampere meter 1116 to monitor the progress of the energization activation operation so that the operation of the power supply for activation 1112 is controlled. FIG. 11B shows an example of the emission current Ie measured by the ampere meter 1116. When application of the pulse voltage from the power supply for activation 1112 is started, the emission current Ie increases with the lapse of time but it becomes saturated to hardly increase in due course of time. In this way, application of the voltage from the power supply for activation 1112 is stopped when the emission current Ie is substantially saturated in order to terminate the energization activation operation. Although not shown, the profile of the current If flowing through the device becomes substantially equal to that of the emission current Ie, and termination of activation can be judged based on monitoring this coincidence. It is to be noted that the above energization condition is a preferred condition relating to the surface conduction electron-emitting device according to this embodiment and it is desirable to adequately change the condition when the design of the surface conduction electron-emitting device is changed. Further, conduction of the above-described preliminary drive operation can stabilize the characteristic of the device.

Figure 9E:
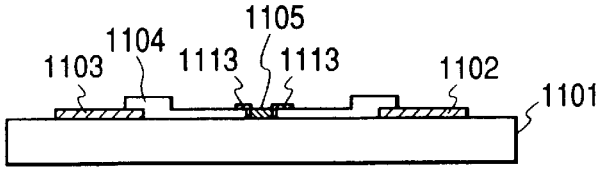

As described above, the plane type surface conduction electron-emitting device shown in FIG. 9E is manufactured.

(Step Type Surface Conduction Electron-emitting Device)

Another typical structure of the surface conduction electron-emitting device in which the electron-emitting region or its peripheral region is formed by the fine grain film, i.e., a structure of a step type surface conduction electron-emitting device will now be described.

Figure 12:
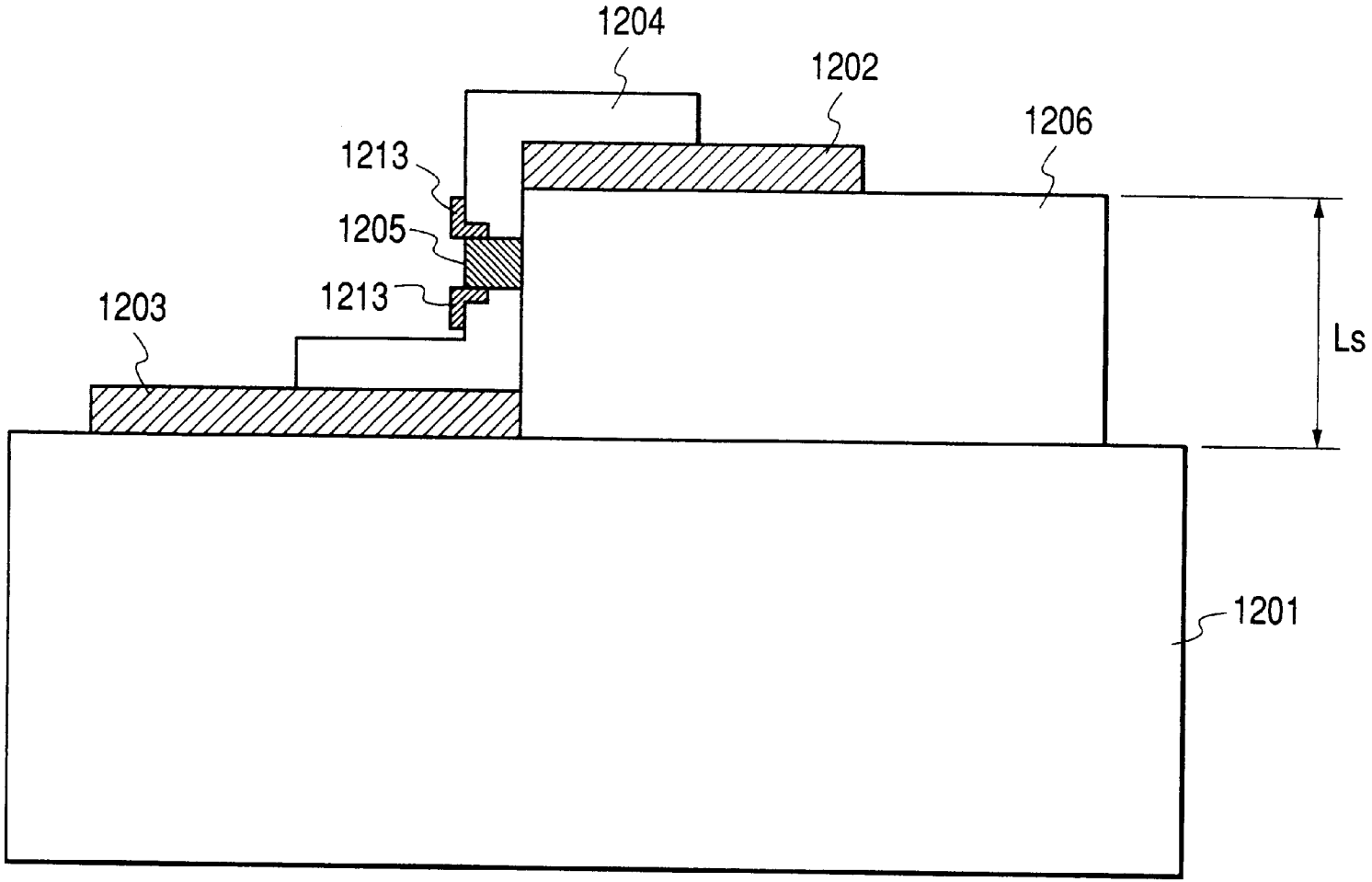
FIG. 12 is a schematic plan view and a cross-sectional view showing a step type surface conduction electron-emitting device to which the present invention can be applied.

FIG. 12 is a typical cross-sectional view for explaining the basic structure of the step type device. In the drawing, reference numeral 1201 denotes a substrate; 1202 and 1203, device electrodes; 1206, a step-forming member; 1204, an electroconductive thin film using a fine grain film; 1205, an electron-emitting region formed by the energization forming operation; and 1213, a thin film formed by the energization activation operation.

A difference of the step type from the plane type described above lies in that one (1202) of the device electrodes is provided on the step-forming member 1206 and the electroconductive thin film 1204 covers the side surface of the step-forming member 1206. Therefore, the gap between the device electrodes L in the plane type shown in FIGS. 8A and 8B is set as a step height Ls of the step-forming member 1206 in the step type.

It is to be noted that the materials named in the above description on the plane type can be similarly used for the substrate 1201, the device electrodes 1202 and 1203 and the electroconductive thin film 1204 using the fine grain film 1204. Further, an electrical insulating material such as $SiO_2$ is used for the step-forming member 1206.

Description will now be given as to the manufacturing method of the step type surface conduction electron-emitting device. FIGS. 13A to 13F are cross-sectional views for explaining the manufacturing process, and reference numerals of the constituent parts are equal to those in FIG. 12.

Figure 13A:
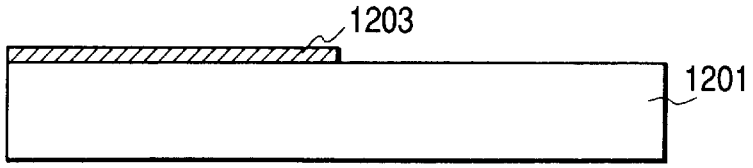
FIGS. 13A, 13B, 13C, 13D, 13E and 13F are views showing a manufacturing process of the electron-emitting device of FIG. 12.

1) As shown in FIG. 13A, the device electrode 1203 is first formed on the substrate 1201.

Figure 13B:
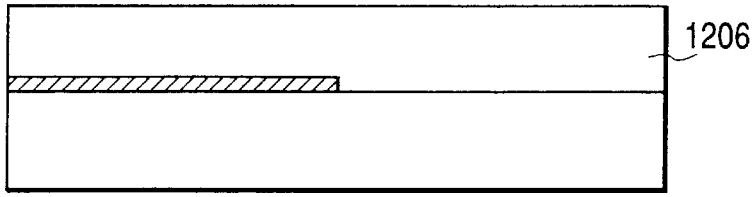

2) As shown in FIG. 13B, an insulation layer for forming the step-forming member is laminated. Although the insulation layer is laminated by spattering, e.g., $SiO_2$, any other film formation method such as a vacuum evaporation method or a printing method may be used.

Figure 13C:
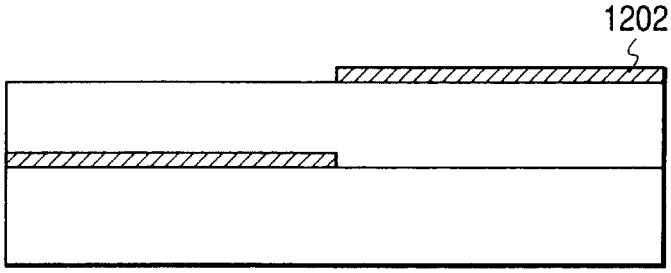

3) As shown in FIG. 13C, the device electrode 1202 is then formed on the insulation layer.

Figure 13D:
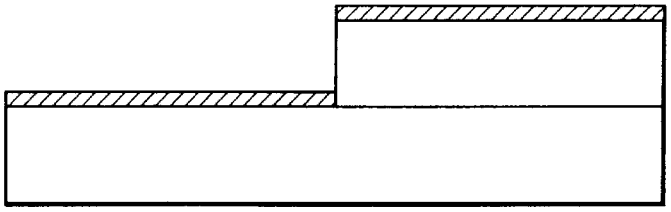

4) Subsequently, as shown in FIG. 13D, a part of the insulation layer is removed by using, e.g., an etching method to expose the device electrode 1203.

Figure 13E:
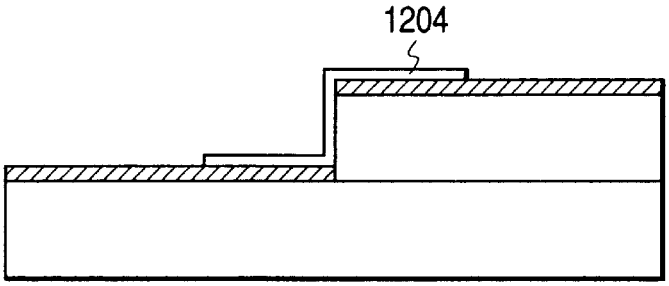

5) As shown in FIG. 13E, the electroconductive thin film 1204 using the fine grain film is then formed. For forming this film, a film formation technique such as a coating method may be used as similar to the plane type.

6) The energization forming operation is then carried out as similar to the plane type to form the electron-emitting region (the operation which is the same as energization forming operation of the plane type described in connection with FIG. 9C can be effected).

Figure 13F:
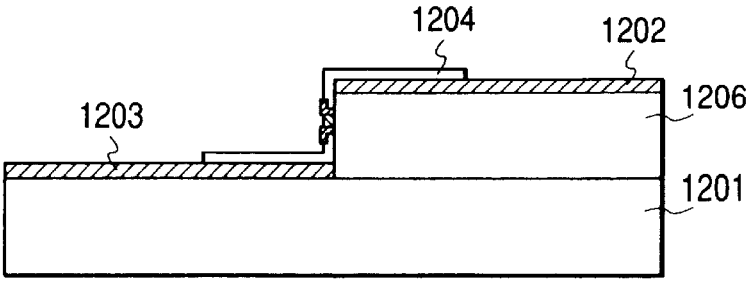

7) The energization activation operation is subsequently carried out as similar to the plane type so that the carbon or the carbon compound is deposited in the vicinity of the electron-emitting region (the operation equal to the energization activation operation of the plane type described with reference to FIG. 9D can be used). Further, conduction of the above-described preliminary drive operation can stabilize the characteristic of the device. In this manner, the step type surface conduction electron-emitting device shown in FIG. 13F is manufactured.

(Characteristic of Surface Conduction Electron-emitting Device Used in Display Apparatus)

The above has described on the device structure and the manufacturing method of the plane type and step type surface conduction electron-emitting devices, and the characteristic of the device used in the display apparatus will now be explained.

Figure 14:
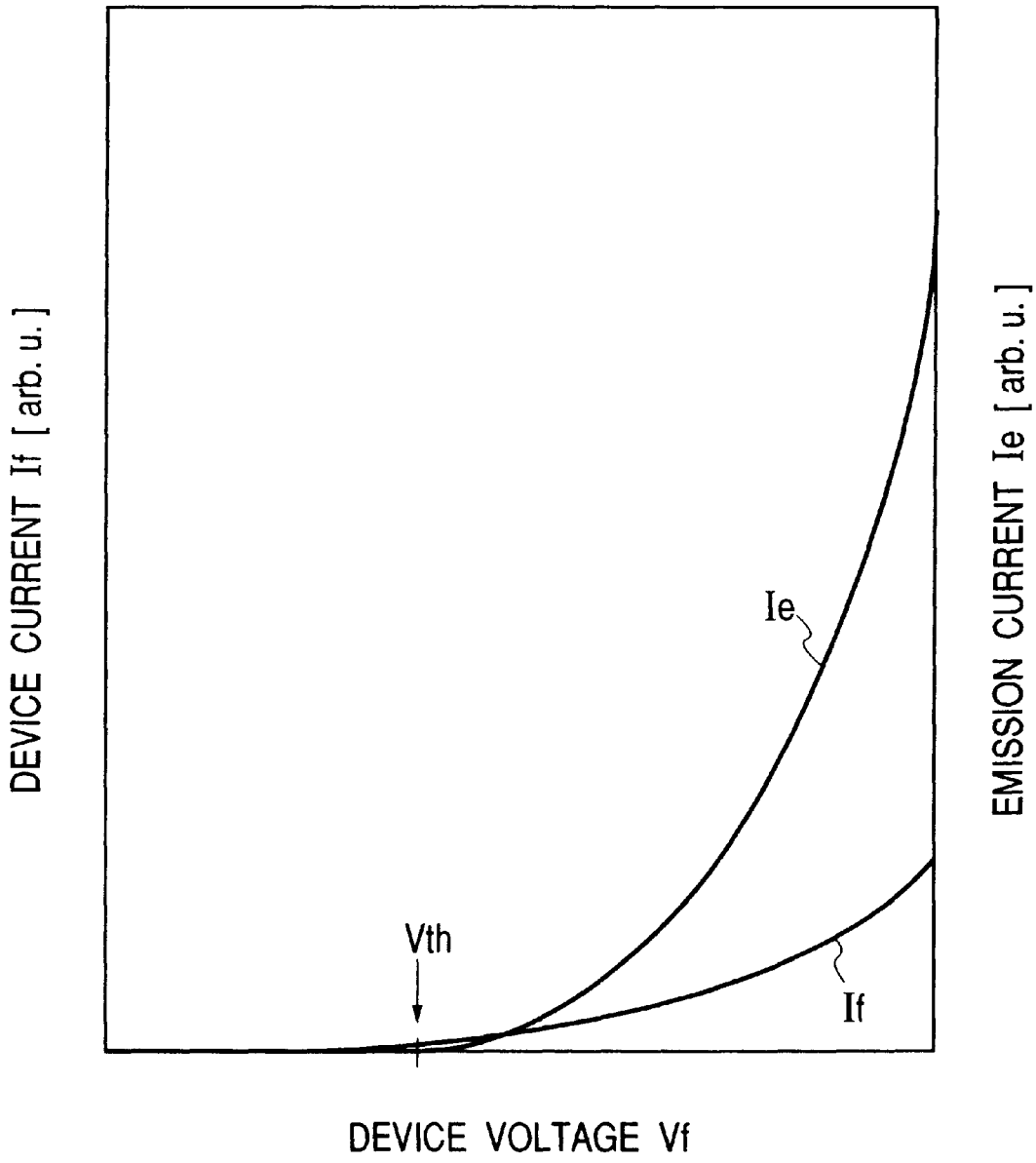
FIG. 14 is a view showing an electric characteristic of a surface conduction electron-emitting device to which the present invention can be applied.

FIG. 14 shows a typical example of a characteristic of (the emission current Ie) to (the voltage Vf applied to the device) and a characteristic of (the device current If) to (the voltage Vf applied to the device) of the device used in the display apparatus. Incidentally, partly since the emission current Ie is considerably smaller than the device current If and it is hard to be illustrated on the same scale and partly since these characteristics vary by changing design parameters of a size, a shape and others of the device, the two graphs are shown in respective arbitrary units.

The device used in the display apparatus has the following three characteristics relating to the emission current Ie.

Firstly, application of a voltage equal to or higher than a given voltage (which will be referred to as a threshold voltage Vth) to the device can rapidly increase the emission current Ie, whilst the emission current Ie is hardly detected when a voltage lower than the threshold voltage Vth is applied.

That is, the device is a non-linear device having clear threshold voltage Vth with respect to the emission current Ie.

Secondly, since the emission current Ie changes in dependence on the voltage Vf applied to the device, an intensity of the emission current le can be controlled by using the voltage Vf.

Thirdly, since the response speed of the current Ie emitting from the device is high relative to the voltage Vf applied to the device, an electric charge amount of the electron emitted from the device can be controlled in accordance with a length of the time for applying the voltage Vf.

With such characteristics, the surface conduction electron-emitting device can be preferably used in the display apparatus. For example, in the display apparatus in which a plurality of devices are provided in accordance with pixels of a display screen, utilization of the first characteristic enables sequential scanning of the display screen for performing display. That is, a voltage equal to or above the threshold voltage Vth is appropriately applied to the currently driven device in accordance with a desired luminescent brightness, and a voltage lower than the threshold voltage Vth is applied to the non-selected device. Sequentially switching the driven devices can ensure sequential scanning of the display screen in order to perform display.

Further, utilization of the second or third characteristic can control the luminescent brightness, and the gradation display is hence enabled.

(Structure of Multi-electron Source Having Plural Devices Wired in Simple Matrix)

Description will now be given as to the structure of a multi-electron source in which the above-describe surface conduction electron-emitting devices are arranged on the substrate and wired in a simple matrix form.

Figure 15:
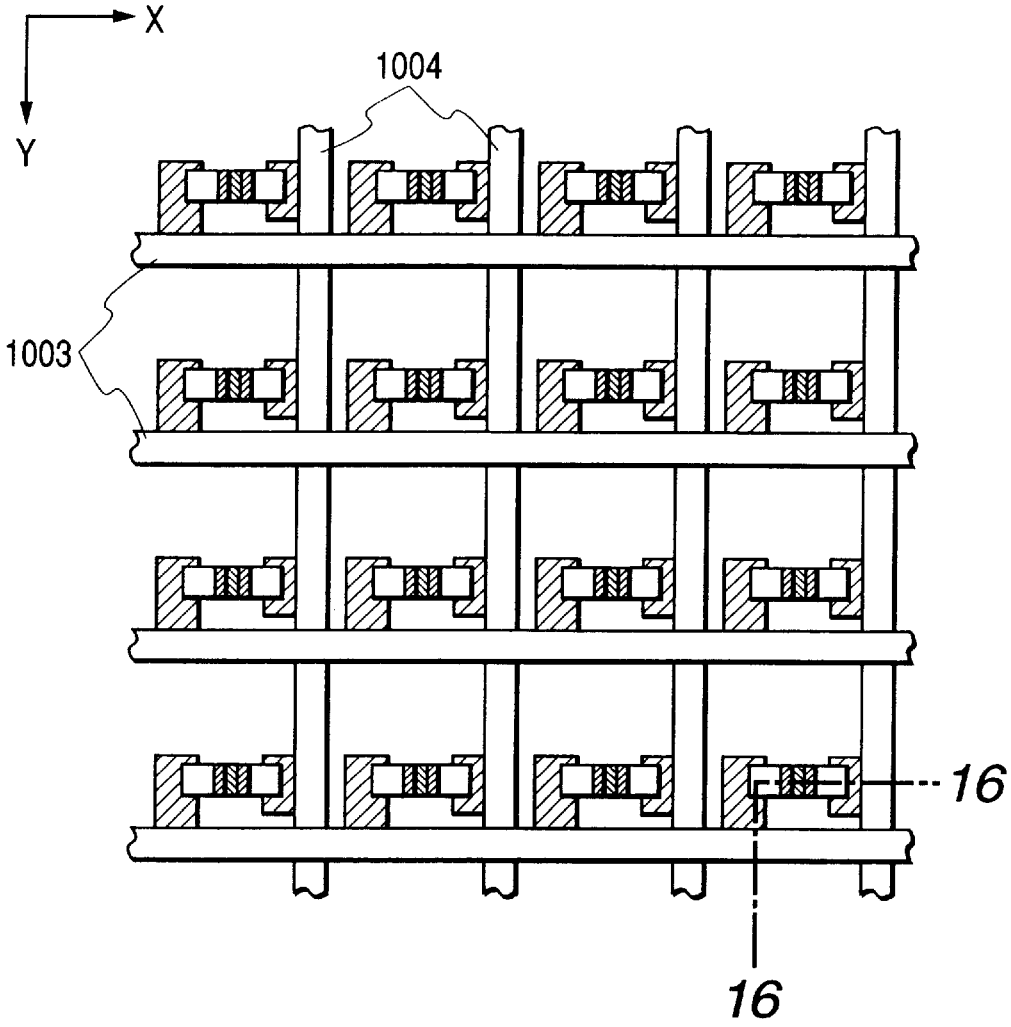
FIG. 15 is a plan view of a multi-electron beam source for use in the display panel of FIG. 6.

FIG. 15 is a plan view of a multi-electron source used in the display panel shown in FIG. 6. The surface conduction electron-emitting devices similar to those in FIGS. 8A and 8B are arranged on the substrate and wired in the simple matrix form by the row-directional wiring electrodes 1003 and the column-directional wiring electrodes 1004. An insulation layer (not shown) is formed between the electrodes at an intersection of the row-directional wiring electrodes 1003 and the column-directional wiring electrodes 1004 in order to maintain the electrical insulation.

Figure 16:
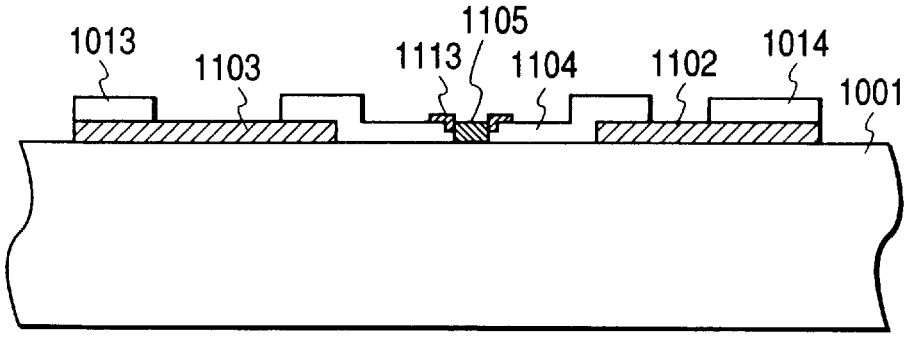
FIG. 16 is a cross-sectional view taken along the line 16—16 of FIG. 15.

FIG. 16 shows a cross section taken along the line 16—16 in FIG. 15.

Incidentally, after the row-directional wiring electrodes 1003, the column-directional wiring electrodes 1004, the insulation layer between the electrodes (not shown), and the device electrodes and the electroconductive thin film of the surface conduction electron-emitting device are formed on the substrate in advance, the multi-electron source having the above-described structure is manufactured by supplying power to each device through the row-directional wiring electrodes 1003 and the column-directional wiring electrodes 1004 to conduct the energization forming operation, the energization activation operation and the preliminary drive operation.

The apparatus and the method for performing the energization activation which take a leading part of the present invention will now be described hereinafter.

Figure 2:
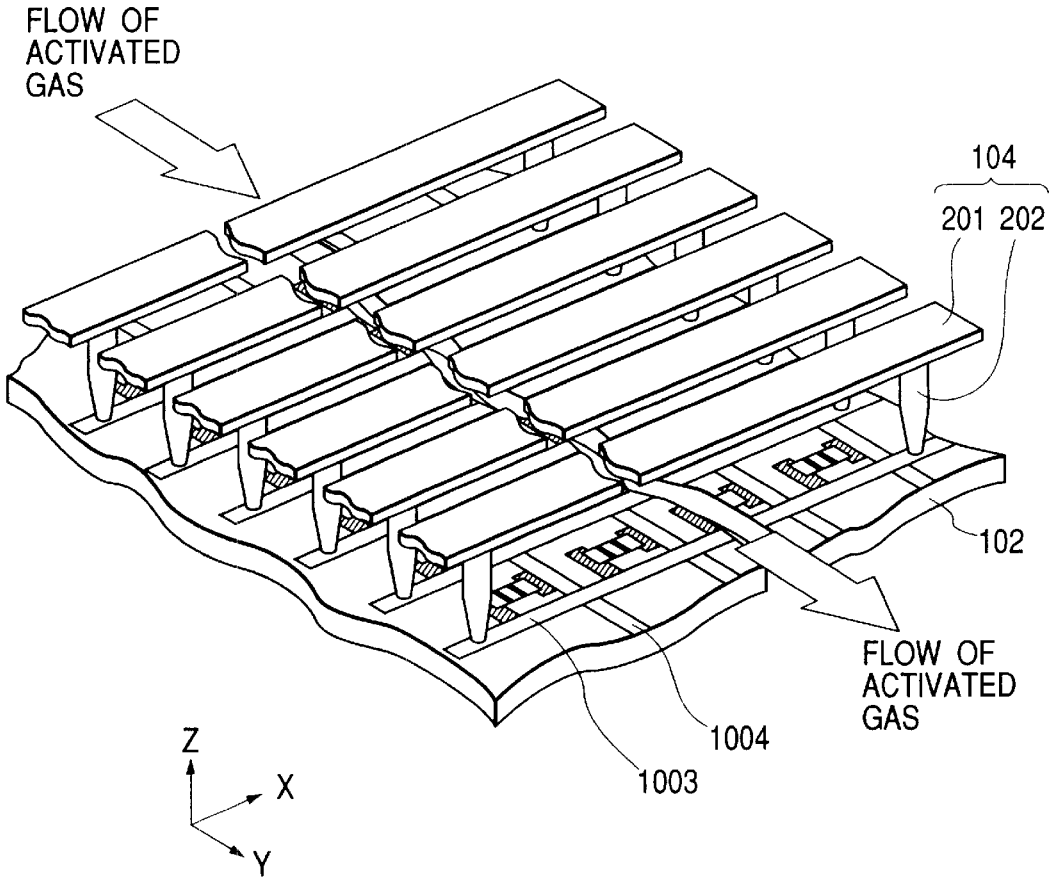
FIG. 2 is a perspective view of a probe section according to the first embodiment of the present invention.
Figure 3:
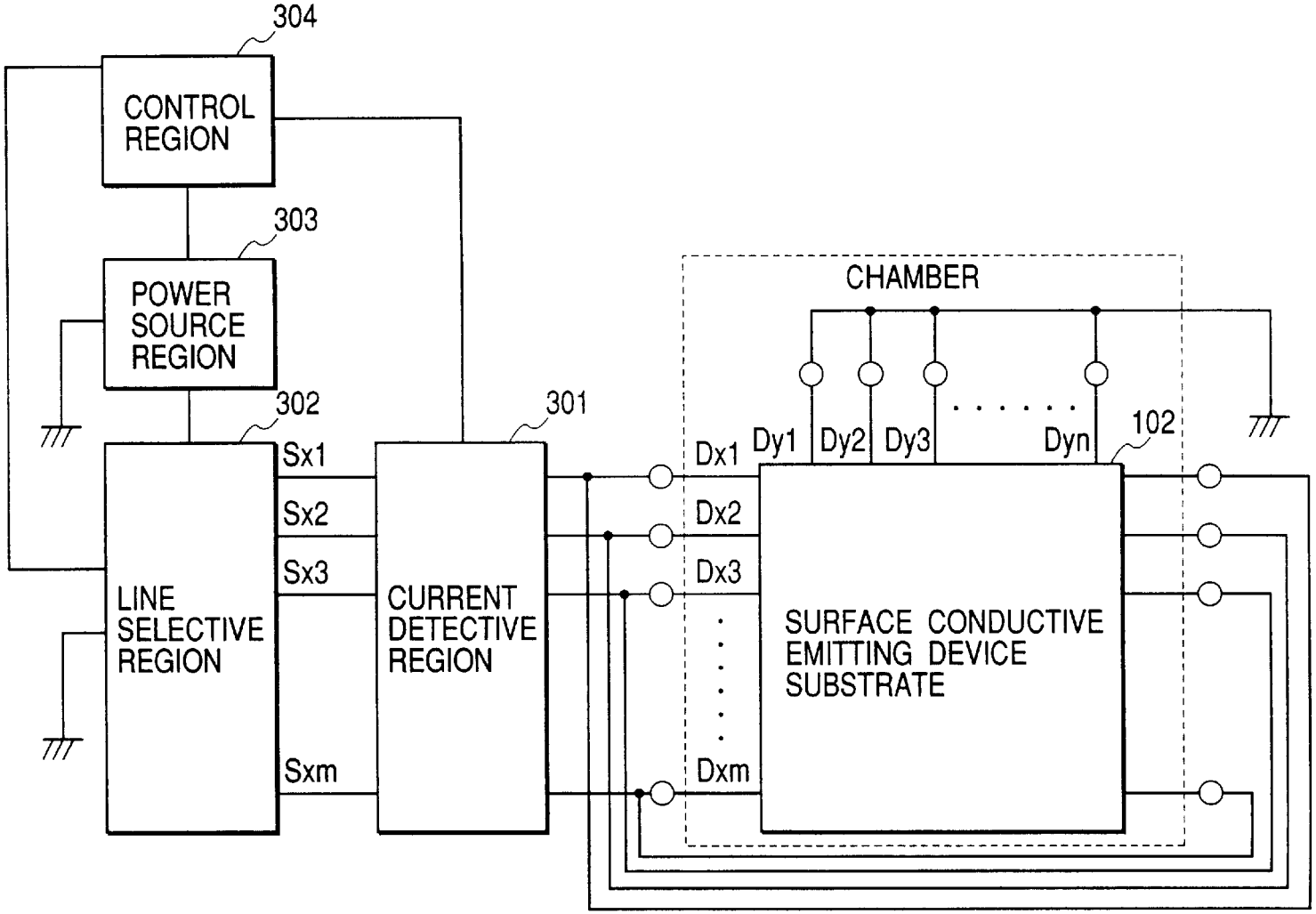
FIG. 3 is a view showing driving means according to the first embodiment of the present invention.

FIGS. 1 to 3 show an energization activation apparatus for the surface conduction emission device according to this embodiment.

FIG. 1 is a schematic cross-sectional view in a so-called vacuum chamber for creating the atmosphere required for activation around the multi-electron source substrate. In the drawing, reference numeral 101 designates a chamber main body; 102, a multi-electron source substrate; 103, a supporting base for the substrate; 104, a wiring (not shown) on the substrate and electrical contacting means which is a so-called a probe section (which will be referred to as a probe section); 105, an activated gas inlet; and 106, an activated gas outlet.

FIG. 2 is a perspective view showing the contact between the probe section 104 and the electron source substrate 102 in the chamber and their arrangement in detail and illustrates the substrate and the probe section partially cutaway. In the drawing, like reference numerals denote the constituent parts which have been already described. Reference numeral 102 designates an electron source substrate shown in FIG. 1, and the row-directional wiring 1003 and the column-directional wiring 1004 are included in its structure. Further, describing in detail, the probe section 104 shown in FIG. 1 is constituted by a probe 202 and an electroconductive member 201, and the probe 202 is in contact with the upper side of the row-directional wiring 1003 in this embodiment. The probe 202 is electrically connected to the electroconductive member 201 and, although not shown, the electroconductive member is taken out from the chamber 101 through an insulation flange and the like in the row-directional wiring unit. Moreover, a pitch at which the probe is in contact with the row-directional wiring is designed in such a manner that a difference in voltage applied to each device which is calculated based on the current If flowing through the device and the wire resistance r of the row-directional wiring is not more than 0.1V or more preferably not more than 0.01V. Here, a method for actually calculating a voltage distribution amount on the wiring based on a pitch number If and r will now be described. Assuming that a number of devices in a pitch is n, a maximum electric current flowing in a device unit is i and the row-directional wiring resistance in the device unit is r, a potential difference ΔV on the row-directional wiring generated in the pitch can be expressed as follows.

$$\Delta V = r \times i \times n(n/2+1)/4$$

($n$ is an even number)

$$= r \times i \times (n-1) \times ((n-1)/2+1)/4 + r \times 1/2$$

($n$ is an odd number)

In this embodiment, assuming that i=2 mA, r=5 mΩ and n=96, ΔV=0.0094V is obtained and the difference in voltage applied to the device can be ignored.

In addition, the contact positions of the probes are aligned between the adjacent row-directional wiring so as not to interrupt the flow of the activated gas as shown in FIGS. 1 and 2. This can cause the activated gas to smoothly flow between the probes and obtain the uniform density of the activated gas in the vicinity of the device.

FIG. 3 shows driving means which is a so-called driver for applying an activation voltage to the multi-electron source substrate provided in the chamber depicted in FIGS. 1 and 2.

In the drawing, reference numeral 102 denotes a multi-surface conduction emission device substrate which is connected for performing the energization activation (the electron source in this embodiment is matrix-wired and the forming is completed), and as shown in FIGS. 1 and 2, this substrate is provided in the chamber. Additionally, reference numeral 301 designates an activation current detecting section; 302, an activation line selecting section; 303, a power supply for generating a voltage required for the energization activation; and 304, a controlling section for controlling the energization activation waveform and the operation of the line selecting section.

Description will now be given on the operation of the driver in conjunction with this drawing. The power supply 303 generates a voltage waveform required for the energization activation and outputs a pulse waveform such as shown in FIG. 11A. Reference characters T3 and T4 in FIG. 11A denote a pulse width and a pulse separation of the voltage waveform, respectively, and T3 is set to 1 microsecond to 10 milliseconds while T4 is set to 10 microseconds to 100 milliseconds in this embodiment. The controlling section 304 controls the power supply 303 based on a previously stored voltage value and specifies a selected line to the line selecting section 302. A voltage waveform outputted from the power supply 303 is inputted to the line selecting section 302 and applied to the selected line of the electron source substrate 102. The line selecting section is constituted by switches such as a relay or an analog switch and, m switches, e.g., sw1 to swm are aligned in parallel and connected to x wiring terminals Dx1 to Dxm of the electron source substrate through the current detecting section 102 when the surface conduction emission device substrate forms a matrix of m×n. The switches are controlled by the controlling section 304 and operate in order that the voltage waveform from the power supply 303 is applied to a line to be subjected to the energization activation.

The energization activation voltage outputted from the line selecting section 302 is inputted to the current detecting section 301. An output from the line selecting section 302 is inputted through the wiring Sx1 to Sxm. The current detecting section is constituted by a voltmeter for measuring the resistance Rs1 to Rsm for detection and the both-end voltages of the resistance.

Description will now be given as to how the controlling section switches the lines to which the activation pulse is applied based on a detected current value.

The current value is measured at predetermined time intervals, and the controlling section compares the measured current value and the previous measured value. If a difference between these values is smaller than a previously stored given value, the controlling section determines that activation of the currently selected line is completed and sends a signal to the line selecting section in order to switch to the next line. That is, completion of the activation is determined when an inclination of increase in If becomes equal to or below a predetermined value. In this manner, the activation is sequentially carried out from the first line to the m-th line.

As described above, activating the multi-surface conduction emission device by using the energization activation apparatus according to this embodiment can obtain the excellent electron-emitting characteristic. Further, when the image-forming apparatus using the electron source is manufactured, an image having the good uniformity and the high definition can be obtained. It is to be noted that connection of the ladder-type wiring as the multi-surface conduction emission device can enable the similar application.

[Embodiment 2]

A second embodiment according to the present invention will now be described in detail hereunder.

Figure 4:
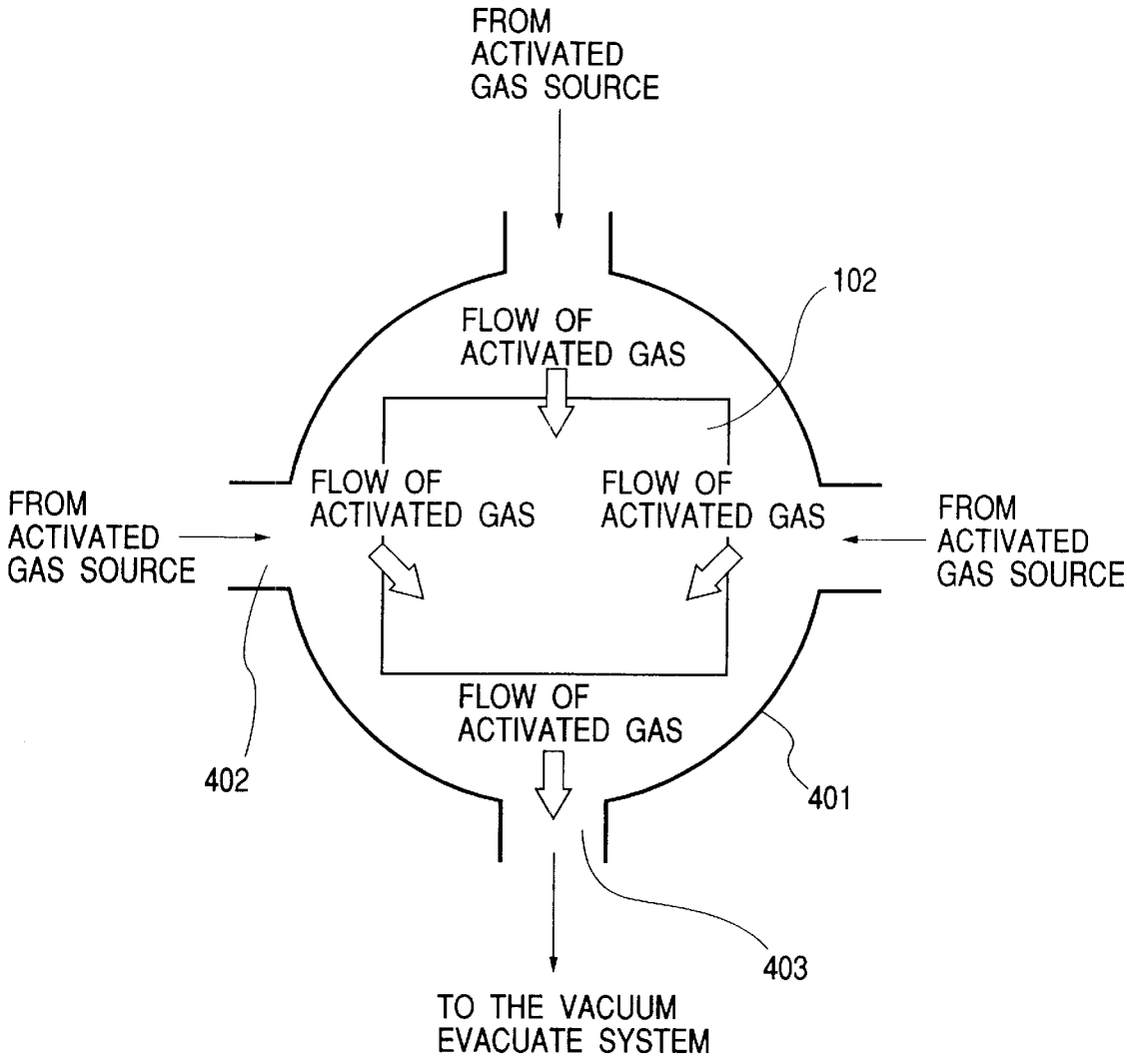
FIG. 4 is a view showing a flow of gas of an energization apparatus according to a second embodiment of the present invention.

FIG. 4 is a plan view showing the vacuum chamber in the activation apparatus according to this embodiment from the top side. In the drawing, reference numeral 102 denotes the above-described multi-electron source substrate; 401, a chamber main body; 402, an activated gas inlet; and 403, an activated gas outlet. Although the probe section used in this embodiment is not illustrated in this drawing for the sake of convenience, this section is separately shown in FIG. 5. As shown in FIG. 4, an increase in number of the gas inlets contributes to uniformization of the flow of the activated gas in the wider area, and this drawing shows a case where there is a portion in which a flow is generated in an inclined direction relative to the electron source substrate. In such a case, the respective probes must be preferably equally separated from each other in order not to obstruct the flow in the inclined direction.

Here, the electron source substrate which is the same as that in the embodiment 1 is used.

Figure 5:
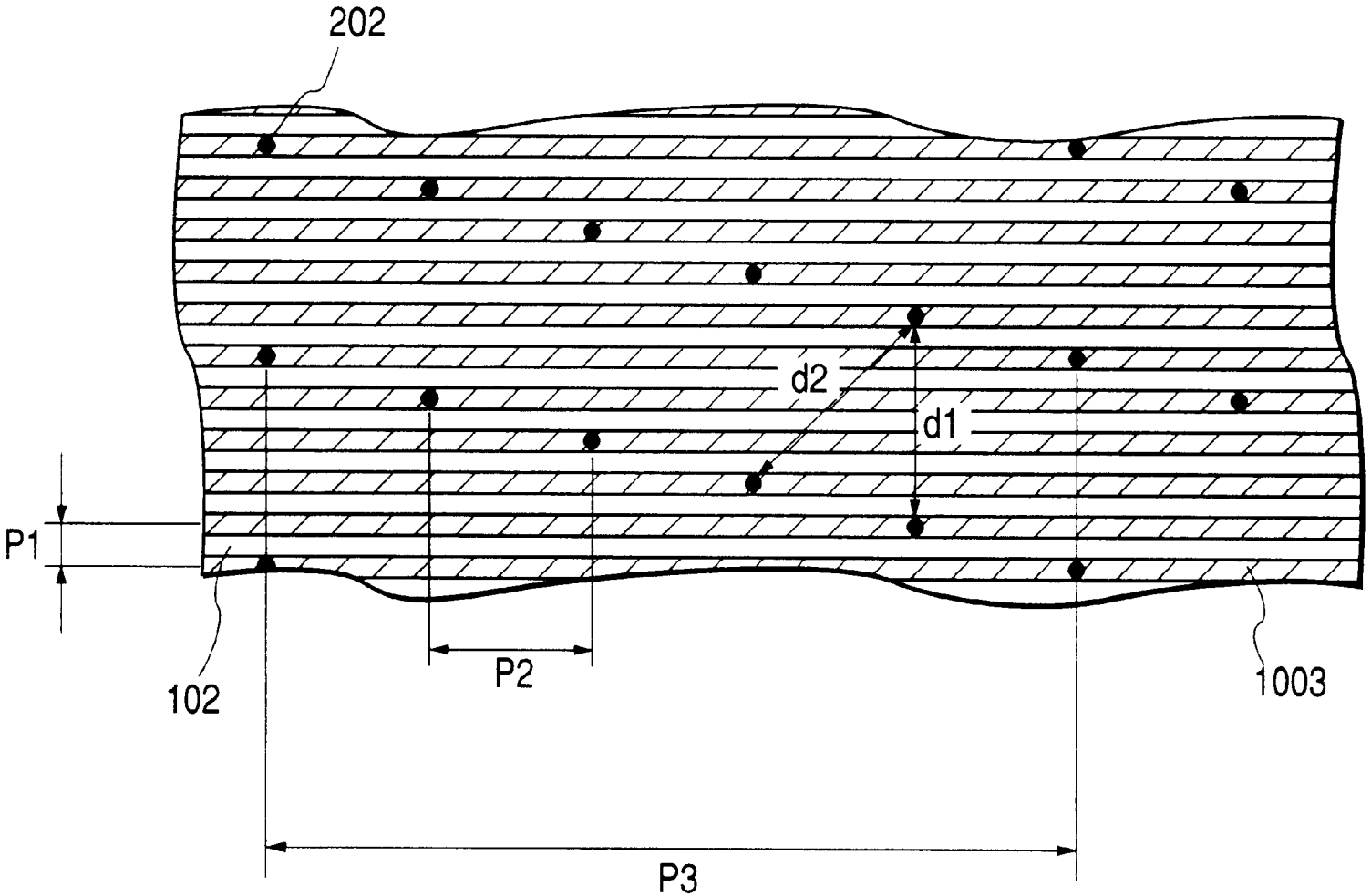
FIG. 5 is a view for explaining the arrangement of a probe according to the second embodiment of the present invention.

Description will now be give as to how to actually dispose the probes with reference to FIG. 5. In FIG. 5, although like reference numeral denote the like or corresponding constituent parts, only the row-directional wiring is illustrated for the sake of convenience and the column-directional wiring and the device section are omitted. Further, in order to explain the arrangement gap between the probes, it is determined that a row-directional wiring pitch is P1, a pitch on the same row-directional wiring is P2 and an X-directional pitch of the probes between the adjacent row-directional wiring is P3. Here, P1 and P3 are the same as above since the multi-surface conduction electron-emitting device substrate equal to that in the embodiment 1 is used. Thus, how to determine P2 is important in this embodiment. In this embodiment, since the design can be facilitated when the repeated pattern is adopted for the structure of the probe, P2 is determined in such a manner P3 is divisible by P2, i.e., it is determined with the following restriction:

$$P3=k\times P2 \text{ (}k\text{ is a positive integer)} \qquad \text{(Expression 11)}$$

In order to determine k based on these assumptions, a gap between the contiguous probes on the adjacent row-directional wiring (d1 in FIG. 5) and a gap between the contiguous probes on the same x coordinate (d2 in FIG. 5) are first calculated. k can be then obtained in such a manner that a smaller one of these gaps can be maximum.

d1 and d2 are expressed as follows:

$$d1=k\times P1$$

$$d2=(P2^2+P1^2)^{1/2} \qquad \text{(Expression 12)}$$

Further, the following formula can be obtained base on (Expression 11):

$$d2=((P3/k)^2+P1^2)^{1/2} \qquad \text{(Expression 13)}$$

Moreover, the following can be obtained in accordance with the embodiment 1:

$$P3=96\times P1/3.6 \text{ (because the column-directional pitch is 1/3.6 of the row-directional wiring pitch)}$$

Finally, the following formula can be derived:

$$P2=((96\times P1/3.6/k)^2+P1)^{1/2} \qquad \text{(Expression 14)}$$

In this embodiment, k=5 is obtained based on the above expressions. That is, the probe is repeatedly provided on the same X-directional coordinate every five row-directional wiring as shown in FIG. 5.

The driver used in the second embodiment is similar to that in the embodiment 1, and its operation is the same, thereby omitting the explanation thereof.

As described above, when the multi-surface conduction emission device is activated by using the energization activation apparatus according to this embodiment, the excellent electron-emitting characteristic can be obtained with respect to all the lines. Further, when the image-forming apparatus using the electron source is manufactured, an image having the excellent uniformity and the high definition can be obtained. Incidentally, even if the ladder-like wiring is connected as the multi-surface conduction emission device, the application is similarly possible.

The above-described structure and means are also effective in the preliminary drive operation explained above, and application of these can improve the uniformity of the device.

A number of wiring, the wiring pitch, the wiring resistance and others are not restricted to those in the embodiments 1 and 2, and it is needless to say that the pitch of the probes applied to them can be appropriately changed so as not to affect the device characteristic.

[Embodiment 3]

Figure 28:
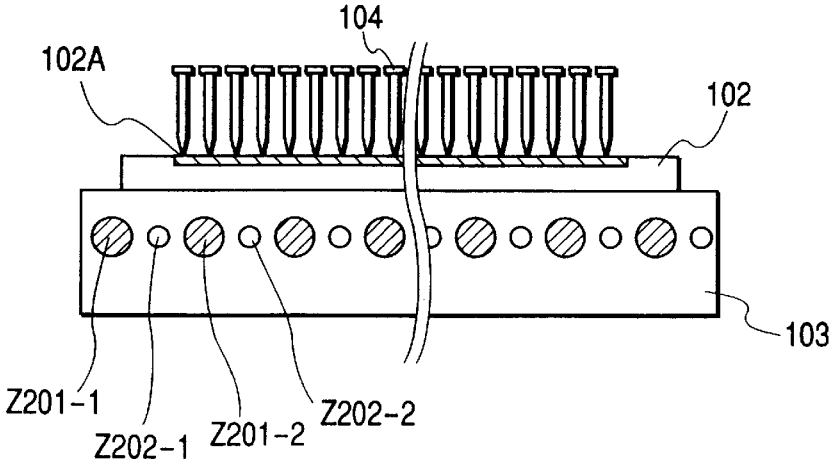
FIG. 28 is a cross-sectional view showing a substrate supporting base in the embodiment 3.
Figure 27:
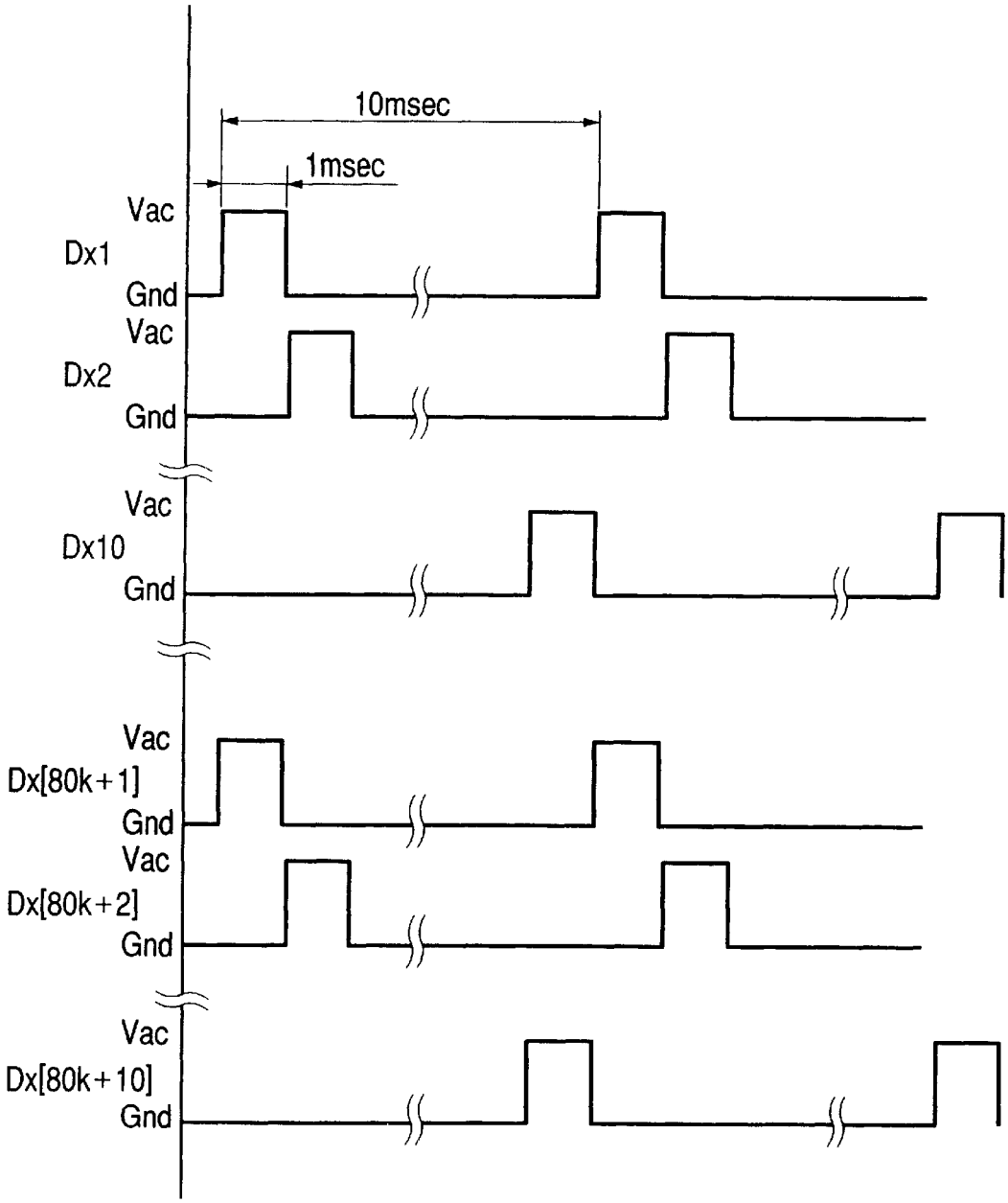
FIG. 27 is a view showing a drive timing chart for activation in the embodiment 3.
Figure 29:
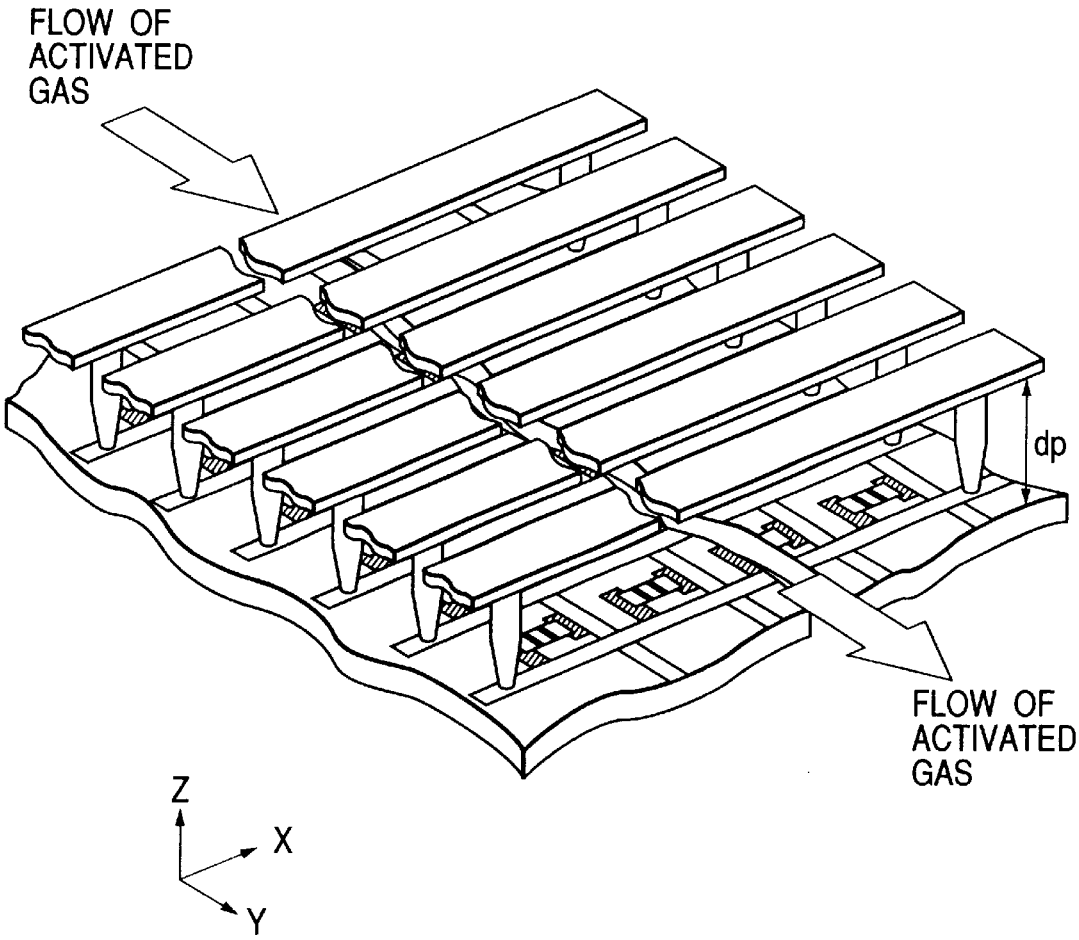
FIG. 29 is a perspective view of a probe section in the embodiment 3.

This embodiment will now be described with reference to FIGS. 27 to 29.

The activation drive method in this embodiment will first be explained. Here, the activation drive apparatus shown in FIG. 3 is also used in this embodiment.

A difference of the drive method from that in the foregoing embodiment lies in that 6 lines are simultaneously selected by the line selecting section 302 and a voltage is applied to these lines. In regard to the drive waveform, T3=1 msec and T4=10 msec shown in FIG. 11A are used. 60 lines are simultaneously scanned and subjected to the activation driving by switching the selected lines every T3. FIG. 27 shows the drive timing chart of this operation. The timing chart shows that the voltage pulses are simultaneously applied every 80 lines. This drive method can greatly reduce the activation driving time (reduction to 1/60 of the time when driving every one line).

The atmosphere for performing the activation can be realized by disposing the multi-electron source substrate 102 in the vacuum chamber 101 as similar to FIG. 1. A difference of this embodiment from the foregoing embodiment is the substrate supporting base 103, and FIG. 28 shows the substrate supporting base in this embodiment.

As described above, since the voltage is applied to the multi-electron source in which six lines are simultaneously selected to perform the activation, heat in the substrate is largely increased. Assuming that the activation voltage Vact is 16V and If of each device immediately before completion of the activation is 3 mA, this heat can reach the following value:

$$Q=16\times0.003\times3072\times6\propto900\ \mathrm{W}$$

Furthermore, this heat is not necessarily generated uniformly in the entire multi-electron source substrate but concentrated on the matrix device region of the substrate, and it is not generated in the peripheral region such as the outtake wiring section. Reference numeral 102A represents a heating section of the substrate. Therefore, heater units Z201-1, Z201-2 and water cooling tubes Z202-1, Z202-2, . . . are provided in the substrate supporting base 103 in order to improve or eliminate the generated temperature distribution, and they are controlled by a non-illustrated temperature controller in accordance with each unit so that the entire multi-electron source substrate has a set temperature Tset. The temperature control is required because the subsequent device characteristics (If, Ie) change in dependence on a temperature of the substrate during the activation and generation of the temperature distribution on the activated substrate causes the characteristic distribution of the multi-electron source to occur.

The installation height of the probe electroconductive member 201 will now be explained with reference to FIG. 29.

In this embodiment, a supply amount of the activation material (organic compound) gas is greatly increased in order to perform the activation driving with respect to six lines at the same time as described above. This amount is estimated as approximately 50 L/sec from another experiment. When actually flowing this flow rate between the electroconductive member 201 and the substrate, the too small conductance constituted by these members causes a distribution to be generated in the activated gas pressure on the substrate surface. This pressure distribution can consequently be an factor for causing a distribution of the device characteristics (If, Ie). A large conductance must be therefore assured for suppressing the pressure distribution of the activated gas. When an experiment was conducted by changing a gap dp between the substrate surface and the electroconductive member 201 so as to assure the large conductance, the characteristic distribution was substantially suppressed with the gap not less than 10 mm. Accordingly, dp=10 mm is adopted in this embodiment.

As described above, when the multi-surface conduction emission device is activated by using the energization activation apparatus according to the present invention, the excellent electron-emitting characteristic can be obtained with respect to all the lines. Further, when the image-forming apparatus using the electron source is manufactured, an image having the excellent uniformity and the high definition is obtained. It is to be noted that the application is similarly possible even if a device having a ladder-like wiring is connected as the multi-surface conduction emission device.

Since the gap between the substrate surface and the probe electroconductive member 201 must be set larger in accordance with a number of lines simultaneously subjected to the activation drive, an absolute amount of the actually required device characteristics (If and Ie), types of the activated gas and others, it is not restricted to the above value. Further, a number of simultaneously driven lines is not limited to six as described above.

As mentioned above, when the probes electrically contact with the upper part of the wiring are disposed at an appropriate pitch so as not to adversely affect the flow of the activated gas, the voltage distribution generated on the wiring can be eliminated and the electron source having the uniform device characteristic can be realized without the distribution of the activated gas. In addition, the similar structure can be applied in the preliminary drive operation. Moreover, the high-definition image-forming apparatus without irregular brightness can be realized by utilizing this electron source.

What is claimed is:

1. An apparatus for manufacturing an electron source having a plurality of electron-emitting devices provided on a substrate and connected by wiring, comprising:

electrical connecting means connected to said wiring at three or more points.

2. The apparatus for manufacturing an electron source according to claim 1, wherein said electrical connecting means is constituted by three or more contact terminals which are in contact with said wiring at three or more points, and wherein said respective contact terminals are disposed in a region where said electron-emitting devices on said substrate are disposed in such a manner that each gap between adjacent contact terminals becomes the same.

3. The apparatus for manufacturing an electron source according to claim 1, wherein said electrical connecting means comprises three or more contact terminals arranged in contact with said wiring at three or more points, and further comprising means for supplying an activated material gas, said contact terminals being disposed so as to be parallel to a flow of the activated material gas.

4. The apparatus for manufacturing an electron source according to claim 1, further comprising driving means for generating a voltage required for performing an operation for energizing said electron-emitting device through said electrical connecting means so that the generated gas is supplied to said electron-emitting device.

5. A method for manufacturing an electron source having a plurality of electron-emitting devices provided on a substrate and connected by a wiring, comprising a step of energizing from electrical connecting means connected to said wiring at three or more points.

6. The method for manufacturing an electron source according to claim 5, wherein said electrical connecting means is brought into contact with said wiring at three or more points.

7. The method for manufacturing an electron source according to claim 5, wherein said electrical connecting means includes a member whose resistance is lower than that of said wiring.

8. The method for manufacturing an electron source according to claim 7, wherein drive with said voltage V1 is continued until a rate of change of a value of the following expression becomes more than 5%:

$$f(V)/\{V1\times f'(V1)-2f(V1)\}.$$

9. The method for manufacturing an electron source according to claim 5, wherein said electrical connecting means has three or more contact terminals brought into contact with said wiring at three or more points.

10. The method for manufacturing an electron source according to claim 9, wherein said respective contact terminals are disposed in a region in which said electron-emitting devices on said substrate are provided in such a manner that a gap between the adjacent contact terminals becomes equal.

11. The method for manufacturing an electron source according to claim 9, wherein said contact terminals are provided so as to be parallel to a flow of an activated material gas, and wherein said step of energizing is an energization activation step.

12. The method for manufacturing an electron source according to claim 5, wherein said step of energizing is an energization activation step.

13. The method for manufacturing an electron source according to claim 5, wherein said step of energizing is a preliminary drive step by which, assuming that the relationship between an electric current I and a voltage V in a voltage range involving electron emission from said electron-emitting device is represented by a function I=f(V) with respect to an electron-emitting region formed by an energization forming or energization activation step and f'(V) is a differential coefficient of f(V) under said voltage (V), after a preliminary drive voltage V1 is used to perform driving in advance, usual driving is carried out with a voltage V2 represented as follows:

$$f(V1)/(\{V1\times f'(V1)-2f(V1)\}>f(V2)/\{V2\times f'(V2)-2f(V2)\}.$$

14. The method for manufacturing an electron source according to claim 13, wherein, assuming that an electric current flowing to said electron-emitting device when said voltage V2 is applied to drive said electron-emitting device after said step of energizing is I2 and an electric current flowing to said electron-emitting device when said voltage V1 is applied to said electron-emitting device in said step of energizing is I1, said voltage V1 is set to a voltage with which $I2 \leqq 0.7I1$ is obtained.

15. The method for manufacturing an electron source according to claim 5, wherein, in said electron source, a plurality of said electron-emitting-devices are laid out in a matrix form, one terminal of said electron-emitting device laid out in the same row is connected to a wiring in a direction of the same row, and another terminal of said electron-emitting device laid out in the same column is connected to a wiring in a direction of the same column.

16. The method for manufacturing an electron source according to claim 5, wherein, in said electron source, a plurality of said electron-emitting devices are linearly laid out, terminals of said electron-emitting devices on the same side are commonly connected, and terminals on the opposed side are connected to a different common wiring.

17. A method for manufacturing an electron source, comprising the steps of:

forming a plurality of electroconductive films provided on a substrate and connected by a wiring; and energizing a plurality of said electroconductive films by electrical connecting means connected to said wiring at three or more points, wherein a temperature of said substrate is controlled in said step of energizing.

18. The method for manufacturing an electron source according to claim 17, wherein said step of energizing is carried out in an atmosphere where an organic compound exists.

19. A method for manufacturing an electron source comprising the steps of:

forming a plurality of electroconductive films matrix-wired by a plurality of row-directional wiring and a plurality of column-directional wiring; and energizing a plurality of said electroconductive films by electrical connecting means connected to two or more of said row-directional wiring and connected to said two or more row-directional wiring at three or more points, wherein a temperature of said substrate is controlled in said energizing step.

* * * * *

UNITED STATES PATENT AND TRADEMARK OFFICE

CERTIFICATE OF CORRECTION

PATENT NO. : 6,638,128 B1
DATED : October 28, 2003
INVENTOR(S) : Noritake Suzuki It is certified that error appears in the above-identified patent and that said Letters Patent is hereby corrected as shown below:

Title page,
Item [57], ABSTRACT,
Line 1, “is” should be deleted and “formed” should read -- is formed --.

Column 1,
Line 27, “molybdenium” should read -- molybdenum --.

Column 3,
Line 28, “high,” should read -- is high --.

Column 10,
Line 16, “*f*(V1)” should read -- *f*(V1) -- and “*f*(V2)” should read -- *f*(V2) --

Column 11,
Lines 14 and 17, “current le” should read -- current Ie --.
Line 24, “between Fe” should read -- between Ie --.

Column 12,
Line 12, “emitting” (second occurrence) should be deleted.

Column 21,
Line 17, “current le” should read -- current Ie --.

Column 24,
Line 64, “+*P*1)” should read -- +$P1^2$) --.

UNITED STATES PATENT AND TRADEMARK OFFICE

CERTIFICATE OF CORRECTION

PATENT NO. : 6,638,128 B1
DATED : October 28, 2003
INVENTOR(S) : Noritake Suzuki It is certified that error appears in the above-identified patent and that said Letters Patent is hereby corrected as shown below:

Column 25,
Line 56, "∝900 W" should read -- ≃900 W --.

Signed and Sealed this

Fifteenth Day of June, 2004

JON W. DUDAS
*Acting Director of the United States Patent and Trademark Office*